US007887672B2

(12) United States Patent
Yang et al.

(10) Patent No.: US 7,887,672 B2
(45) Date of Patent: Feb. 15, 2011

(54) METHOD FOR MAKING NATURAL CELLULOSIC FIBER BUNDLES FROM CELLULOSIC SOURCES

(75) Inventors: Yiqi Yang, Lincoln, NE (US); Narenda Reddy, Lincoln, NE (US)

(73) Assignee: University of Nebraska-Lincoln, Lincoln, NE (US)

( * ) Notice: Subject to any disclaimer, the term of this patent is extended or adjusted under 35 U.S.C. 154(b) by 886 days.

(21) Appl. No.: 11/675,982

(22) Filed: Feb. 16, 2007

(65) Prior Publication Data

US 2007/0199669 A1 Aug. 30, 2007

Related U.S. Application Data

(63) Continuation-in-part of application No. 11/338,444, filed on Jan. 24, 2006, now abandoned, and a continuation-in-part of application No. PCT/US2005/030180, filed on Aug. 22, 2005.

(60) Provisional application No. 60/648,335, filed on Jan. 28, 2005, provisional application No. 60/699,020, filed on Jul. 13, 2005, provisional application No. 60/699,022, filed on Jul. 13, 2005.

(51) Int. Cl.
*D01C 1/00* (2006.01)
*D21C 5/00* (2006.01)
*D21C 3/02* (2006.01)

(52) U.S. Cl. ..... 162/90; 162/91; 162/96; 162/97; 162/99

(58) Field of Classification Search ..... 162/90, 162/91, 96, 97, 99
See application file for complete search history.

(56) References Cited

U.S. PATENT DOCUMENTS

878 A * 8/1838 Holland ..... 162/90
RE2,365 E * 9/1866 Delisser ..... 162/90
2,698,789 A * 1/1955 Segl ..... 162/17

(Continued)

FOREIGN PATENT DOCUMENTS

CN 1487133 A * 4/2004
JP 57036947 2/1982

OTHER PUBLICATIONS

Ganjyal, Biodegradable Packaging Foams of Starch Acetate Blended with Corn Stalk Fibers, 2004, Journal of Applied Polymer Science, vol. 93, p. 2628 col. 2.*

(Continued)

*Primary Examiner*—Matthew J. Daniels
*Assistant Examiner*—Anthony J Calandra
(74) *Attorney, Agent, or Firm*—Thompson Coburn LLP

(57) ABSTRACT

A method for extracting such natural cellulosic fiber bundles from natural cellulose sources selected from the group consisting of cornhusk, cornstalk, switchgrass leaves, switchgrass stems, rice straw, sorghum leaves, sorghum stems, soybean straw, wheat straw, cotton stems, barley straw, and combinations thereof, the method comprising performing an alkali treatment to partially delignify the cellulose source material and an enzyme treatment to depolymerize hemicellulose, break covalent links between lignin and carbohydrates, and decompose cellulose chains in the natural cellulosic source material, or a combination thereof thereby yielding extracted natural cellulosic fiber bundles having a length that is greater than that of individual cells and a fineness of at least about 1 denier and no greater than about 300 denier.

12 Claims, 8 Drawing Sheets

U.S. PATENT DOCUMENTS

| | | | | |
|---|---|---|---|---|
| 4,359,859 | A | 11/1982 | Bridgehouse et al. | |
| 5,718,802 | A | 2/1998 | Collier et al. | |
| 6,017,870 | A * | 1/2000 | Bower et al. | 510/392 |
| 6,083,582 | A | 7/2000 | Chen et al. | |
| 7,264,690 | B2 * | 9/2007 | Cheng | 162/24 |

OTHER PUBLICATIONS

International Search Report for PCT/US05/030180, published by the International Bureau of WIPO on Jan. 18, 2007 under WO 2007/008228 A1.

Akin, D. E. and Rigsby, L. L., Quality Properties of Flax Fibers Retted with Enzymes, Textile Research Journal, Oct. 1999, 747-753, 69(10).

Barl, B., et al., Combined Chemical and Enzymic Treatments of Corn Husk Lignocellulosics, J. Sci. Food Agric., 1991, 195-214, 56.

Reddy, N. and Yang, Y., Biofibers from agricultural byproducts for industrial applications, Trends in Biotechnology, Jan. 2005, 22-27, 23(1), Elsevier Ltd.

Reddy, N. and Yang, Y., Long Natural Cellulosic Fibers from Cornhusks: Structure and Properties, AATCC Review, Jul. 2005, 24-27, www.AATCC.Org.

Reddy, N. and Yang, Y., Properties of High-Qualify Long Natural Cellulose Fibers from Rice Straw, Journal of Agricultural and Food Chemistry, 2006, 8077-8081, 54, American Chemical Society.

Reddy, N. and Yang, Y., Properties and potential applications of natural cellulose fibers from cornhusks, Green Chemistry, 2005, 190-195, 7, The Royal Society of Chemistry.

Reddy, N. and Yang, Y., Structure and properties of high quality natural cellulose fibers and cornstalks, Polymer, 2005, 5494-5500, 46, Elsevier Ltd.

Wang, J. and Ramaswamy, G. N., One-Step Processing and Bleaching of Mechanically Separated Kenaf Fibers: Effects on Physical and Chemical Properties, Textile Research Journal, Apr. 2003, 339-344, 73(4).

* cited by examiner

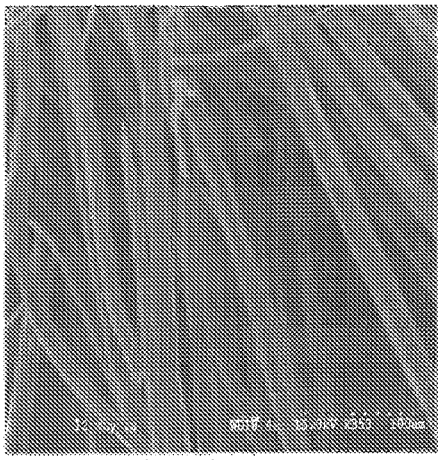
Figure 3a
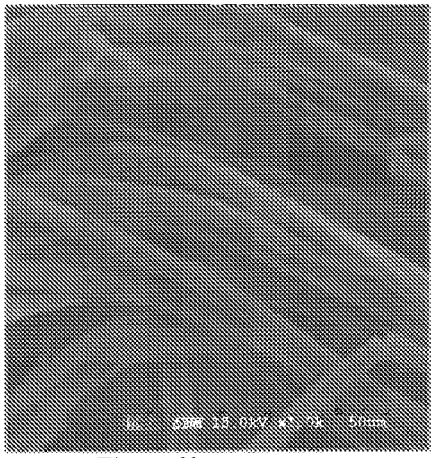
Figure 3b
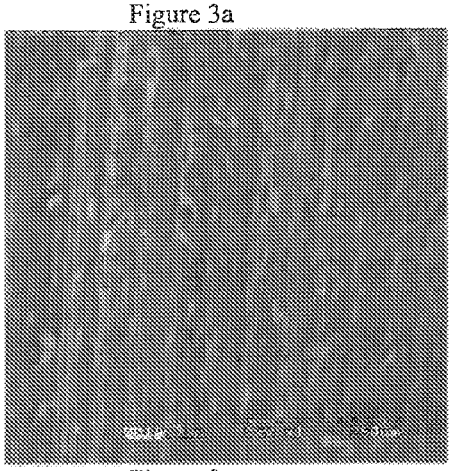
Figure 3c
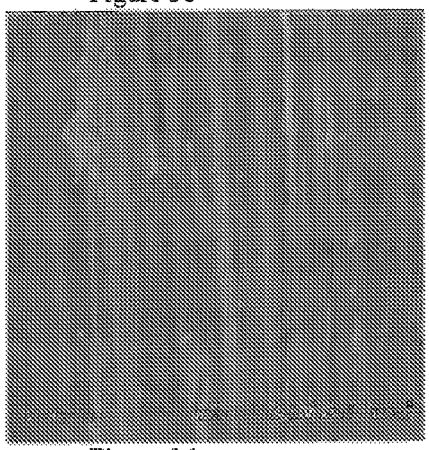
Figure 3d
Figure 3

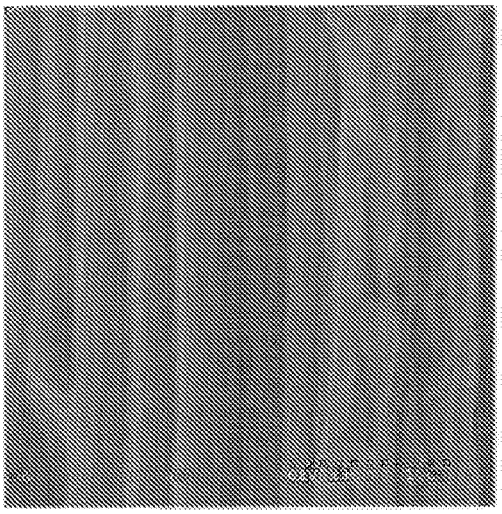
Figure 4a
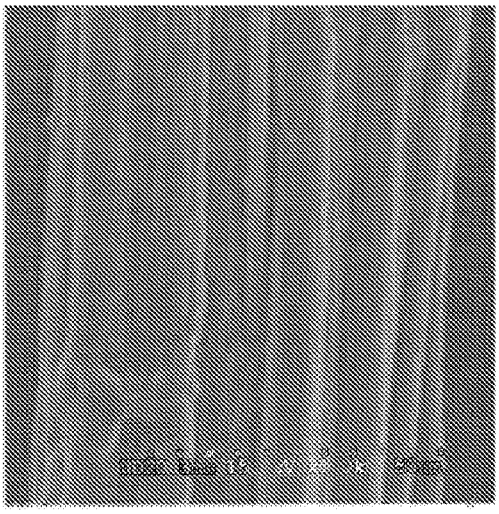
Figure 4b
Figure 4

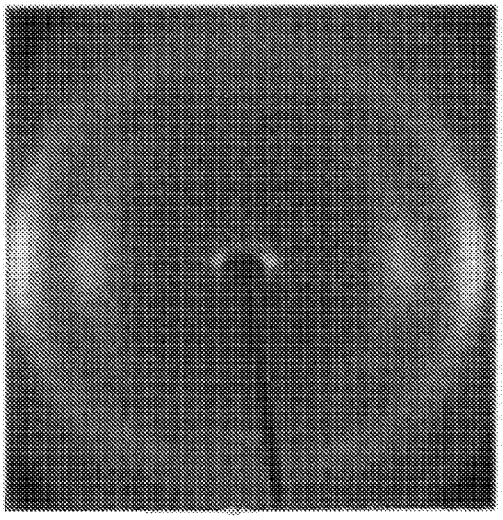
Figure 8a
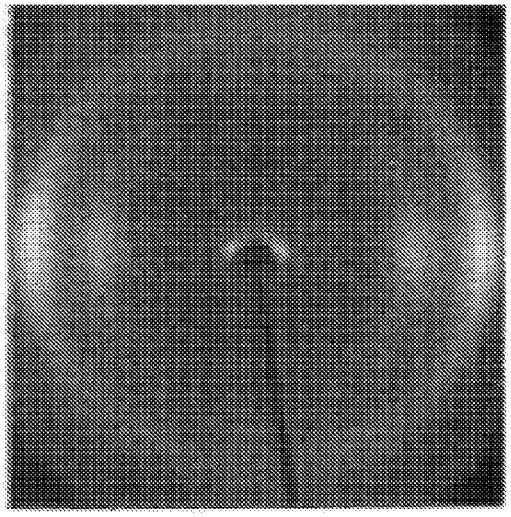
Figure 8b
Figure 8

METHOD FOR MAKING NATURAL CELLULOSIC FIBER BUNDLES FROM CELLULOSIC SOURCES

CROSS REFERENCE TO RELATED APPLICATIONS

The present application is a continuation-in-part of PCT/US2005/030180, filed on Aug. 22, 2005, which claims priority to U.S. Provisional Patent Application Nos. 60/699,020 and 60/699,022, both of which were filed on Jul. 13, 2005; each of which is hereby incorporated by reference herein in its entirety.

The present application is a continuation-in-part of U.S. patent application Ser. No. 11/338,444, filed on Jan. 24, 2006, now abandoned which claims priority to U.S. Provisional Patent Application No. 60/648,335, filed on Jan. 28, 2005; each of which is hereby incorporated by reference herein in its entirety.

BACKGROUND OF THE INVENTION

1. Field of the Invention

The present invention relates to the field of fibers and products made from fibers, specifically to a novel method for the production of natural cellulosic fiber bundles from stalks (stems or straws), leaves, and husks of cellulose sources such as corn, switchgrass, sorghum, rice, wheat, soybean, cotton, and barley that are suitable for, among other things, textile applications, non-woven mats and filters, and fiber reinforced composites.

2. Description of the Related Technology

Cellulose is the most abundantly available organic matter on earth. Cellulose in its natural and regenerated form is a major source of fiber for textile applications. Globally, farming generates millions of tons of agricultural byproducts each year. Some of the byproducts are used as animal feed and for other small scale applications. Many of the agricultural byproducts contain substantial amounts of cellulose, especially in fibrous form. Utilizing agricultural byproducts more fully would benefit growers economically and provide environmental benefits by reducing the amount of byproduct disposal. Yet another environmental benefit is that products made using these agricultural byproducts may be made 100% bio-degradable (See, e.g., Chen et al., U.S. Pat. No. 6,083,582).

Natural cellulosic fibers, or fiber bundles, are derived from various parts of plants. The fibers are mainly classified as seed fibers (e.g., from cotton and kapok), stem or bast fibers (e.g., from flax, jute, hemp, kenaf, and sugarcane), and leaf fibers (e.g., from pineapple, banana). These fibers may be from plants grown primarily for the fibers (e.g., cotton, flax, hemp, kenaf, etc.) or from plants in which the fibers are primarily considered a byproduct such as coconut (the fibers are often referred to as "coir"), sugarcane, banana, and pineapple. The byproduct-type fibers have not been used extensively for several reasons including limited availability, difficulty in extraction, lesser performance-related properties, and limited growing regions. A general classification of natural textile fibers known to those of ordinary skill in the art is provided in Table A below. Conspicuously missing from the listed subgroups of cellulose fiber classifications are "husk fibers" despite the fact that cornhusk is readily available throughout a wide range of geographic regions. Also missing from the listed subgroups of cellulose fiber classifications are other common biomass sources such as switchgrass, sorghum, and rice straw.

TABLE A

Classification of Natural Textile Fibers*

| Cellulose | Protein | Mineral |
|---|---|---|
| Stem (Bast) | Staple-hair | Asbestos |
| flax, hemp, jute | sheep, goat, alpaca, | chrysotile |
| kenaf, ramie, linen | camel, cashmere, Ilama | crocidolite |
| Fruit | mohair, rabbit, vicuna | |
| shell of coconut (coir) | Filament | |
| Leaf | silk | |
| abaca/manila sisal | | |
| Seed | | |
| cotton, kapok | | |

*http:/www/nexiaonline.com/indusprt/classification.asp

Textile fibers from the stalks or stems and leaves of plants are conventionally extracted by a process known as "retting." A traditional retting process is dew retting, which utilizes bacteria and fungi in the environment to delignify the fibers to a state suitable for processing using conventional textile machinery. Dew retting, however, tends to be inconsistent, tends to result in poor fiber quality, usually can only be performed in limited geographical regions, and occupies agricultural land during the retting process (see, e.g., Akin et al., Textiles Research Journal 69 (10), 747-753 (1999)). Chemical methods for retting have been used and these typically produce fibers that are more consistent and with improved physical properties compared to dew-retted fibers. Typical chemical-retting methods use alkalies in combination with other chemicals. Due to the environmental and waste disposal concerns, however, alternatives to chemical retting are being investigated (see, e.g., Wang et al., Textile Research Journal 73(4), 339-344 (2003)). For example, enzymatic retting is being researched as a more ecological-friendly process for fiber extraction. Cost, quality of fibers obtained, and difficulty in controlling the process have, thusfar, limited the use of enzyme retting in commercial scale applications.

Cornhusk contains about 40% cellulose, about 45% hemicellulose, about 7% lignin, about 2% protein and about 3% ash (see, e.g., Branka et al., Journal of Agricultural Food Chemistry, 34, 1019-1024 (1986)). Cellulose fibers in cornhusk are interconnected with each other to form large bundles that are hundreds of micrometers to millimeters wide. These large bundles are connected to each other by films. The cellulose fibers and fiber bundles are connected, primarily, by lignin and hemicellulose. The ultimate fibers in cornhusk are about 0.5 to about 1 mm in length. These ultimate fibers, which may also be referred to as single fibers or individual cells, are considered to be too short, too weak, or both for textile applications. In general, for a fiber to be considered suitable for textile use, among other things, it preferably has a length that is at least about 1,000 times its diameter. For practical purposes, it is preferred that the fiber length is at least about 1.0 cm. Additionally, a fiber preferably has an adequate tensile strength such as at least about 1 gram per denier. Denier is the common term used to describe the fineness or linear density of a textile material that is quantified as the materials weight in grams per 9,000 meters of that material.

Although the above-described retting processes have been used to produce natural cellulosic fibers from stalks or stems and leaves of plants, to date there has been no process for treating cellulose fiber sources such as cornhusks, cornstalks, cotton stalks, switchgrass stems and leaves, sorghum stems and leaves, rice straw, wheat straw, barley straw, and soybean straw to yield natural cellulosic fibers that are suitable for textile use. More specifically, using known methods for treating bast and leaf fibers to treat cellulose fiber sources such as cornhusks, rice straw, switchgrass, and sorghum results in fibers or fiber bundles that are too coarse, too small, too weak, or a combination of negative attributes that prevent their use in applications such as textiles and fiber reinforced composites. Accordingly, there is a need for a method of processing cellulose fiber sources such as cornhusks, rice straw, switchgrass, and sorghum to yield natural cellulosic fiber bundles that are suitable for textile and other industrial applications.

BRIEF SUMMARY OF THE INVENTION

Briefly, therefore, the present invention is directed to a method for extracting natural cellulosic fiber bundles from a natural cellulosic source material, the method comprising performing an alkali treatment on a natural cellulosic source material to partially delignify the natural cellulosic source material thereby yielding the extracted natural cellulosic fiber bundles having a length that is greater than that of individual cells and a fineness of at least about 1 denier and no greater than about 300 denier.

The present invention is also directed to method for extracting natural cellulosic fiber bundles from cornhusks, the method comprising performing a first portion of an enzyme treatment on a cornhusk material, the first portion of the enzyme treatment comprising contacting the cornhusk material with a first enzyme solution that comprises a xylanase at a concentration that is between about 0.05 and about 5 percent for a duration of about 10 to about 60 minutes to form a first mixture having an first enzyme solution-to-husk ratio between about 1:1 and about 100:1 and is at a temperature within a range of about 10 to about 65° C.; separating the first mixture into a first solids portion comprising the cornhusk material and a first liquid portion comprising the first enzyme solution; performing an alkali treatment on the first solids portion, the alkali treatment comprising contacting the cornhusk material with an alkali solution for a duration of about 15 to about 90 minutes to form a second mixture having a alkali solution-to-husk ratio between about 1:1 and about 100:1 and is at a temperature within a range of about 60 to about 100° C., wherein the alkali solution comprises an alkali compound and has a normality that is between about 0.05 and about 2.5 N; separating the second mixture into a second solids portion comprising the cornhusk material and a second liquid portion comprising the alkali solution; performing a second portion of the enzyme treatment on the second solids portion, the second portion of the enzyme treatment comprising contacting the cornhusk material with a second enzyme solution that comprises a cellulase at a concentration that is between about 0.05 and about 5 percent for a duration of about 10 to about 60 minutes to form a third mixture having an second enzyme solution-to-husk ratio between about 1:1 and about 100:1 and is at a temperature within a range of about 10 to about 65° C.; and separating the third mixture into a second solids portion comprising the natural cellulosic fiber bundles and a third liquid portion comprising the second enzyme solution.

The present invention is further directed to a method for extracting natural cellulosic fiber bundles from a natural cellulosic source material selected from the group consisting of switchgrass leaves, switchgrass stems, rice straw, sorghum leaves, sorghum stems, wheat straw, soybean straw, cotton stems, barley straw, and combinations thereof, the method comprising performing an alkali treatment on a natural cellulosic source material, the alkali treatment comprising contacting the natural cellulosic source material with an alkali solution for a duration of about 15 to about 90 minutes to form a first mixture having a alkali solution-to-solid ratio between about 1:1 and about 100:1 and is at a temperature within a range of about 60 to about 100° C., wherein the alkali solution comprises an alkali compound and has a normality that is between about 0.05 and about 2.5 N; separating the first mixture into a first solid portion comprising the natural cellulosic source material and a first liquid portion comprising the alkali solution; performing an enzyme treatment on the first solid portion, the enzyme treatment comprising contacting the first solid portion with an enzyme solution that comprises an enzyme at a concentration between about 0.05 and about 5 percent for a duration of about 10 to about 60 minutes to form a second mixture having an enzyme solution-to-solid ratio between about 1:1 and about 100:1 and is at a temperature within a range of about 10 to about 65° C.; and separating the second mixture into a second solid portion comprising the natural cellulosic fiber bundles and a second liquid portion comprising the enzyme solution.

Additionally, the present invention is directed to natural cellulosic fiber bundles extracted from a natural cellulosic source material selected from the group consisting of cornhusk, switchgrass leaves, switchgrass stems, rice straw, sorghum leaves, sorghum stems, wheat straw, soybean straw, cotton stems, barley straw, and combinations thereof, the natural cellulosic fiber bundles having a length greater than that of individual cells and a fineness that is between about 1 and about 300 denier.

Still further, the present invention is directed to a textile comprising natural cellulosic fiber bundles extracted from a natural cellulosic source material selected from the group consisting of cornhusk, switchgrass leaves, switchgrass stems, rice straw, sorghum leaves, sorghum stems, wheat straw, soybean straw, cotton stems, barley straw, and combinations thereof, wherein the natural cellulosic fiber bundles have a length greater than that of individual cells and a fineness that is between about 1 and about 300 denier.

Moreover, the present invention is directed to a composite structure comprising natural cellulosic fiber bundles extracted from a natural cellulosic source material selected from the group consisting of cornhusk, switchgrass leaves, switchgrass stems, rice straw, sorghum leaves, sorghum stems, wheat straw, soybean straw, cotton stems, barley straw, and combinations thereof, wherein the natural cellulosic fiber bundles have a length greater than that of individual cells and a fineness that is between about 1 and about 300 denier.

Furthermore, the present invention is directed to a non-woven structure comprising natural cellulosic fiber bundles extracted from a natural cellulosic source material selected from the group consisting of cornhusk, switchgrass leaves, switchgrass stems, rice straw, sorghum leaves, sorghum stems, wheat straw, soybean straw, cotton stems, barley straw, and combinations thereof, wherein the natural cellulosic fiber bundles have a length greater than that of individual cells and a fineness that is between about 1 and about 300 denier.

BRIEF DESCRIPTION OF THE FIGURES

FIG. 1*a* is a longitudinal view of a single cornhusk fiber bundle. FIG. 1*b* is a longitudinal view of an untreated cornhusk strand. FIG. 1*c* is a longitudinal view of a cornhusk fiber bundle of the present invention. FIG. 1*d* is a cross-sectional view of untreated cornhusk strand. FIG. 1*e* is a cross-sectional view of a cornhusk fiber bundle of the present invention.

FIG. 3 is scanning electron microscope ("SEM") images of single cells and untreated stem and leaf from switchgrass. FIG. 3*a* is a SEM image of single cells from the stem of switchgrass. FIG. 3*b* is a SEM image of single cells from the leaves of switchgrass. FIG. 3*c* is a SEM image of the surface of an untreated switchgrass stem. FIG. 3*d* is a SEM image of the surface of an untreated switchgrass leaf.

FIG. 4 is SEM images of switchgrass fiber bundles. FIG. 4*a* is a SEM image of a fiber bundle from a switchgrass stem of the present invention. FIG. 4*b* is a SEM image of a fiber bundle from a switchgrass leaf of the present invention.

FIG. 8 is X-ray diffraction patterns of sorghum fiber bundles. FIG. 8*a* is an X-ray diffraction pattern of sorghum leaf fiber bundle. FIG. 8*b* is an X-ray diffraction pattern of sorghum stem fiber bundle.

DETAILED DESCRIPTION OF THE INVENTION

Figure 1:
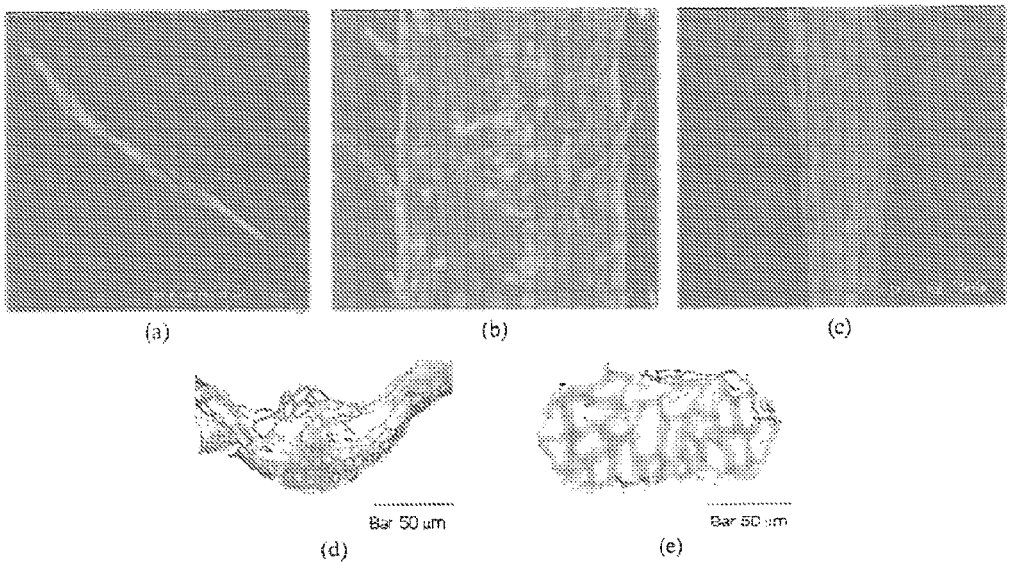
FIG. 1 is scanning electron microscope or light microscope images of cornhusk fiber bundles.

The present invention, among other things, is directed to a process for treating stalks (stems or straws), leaves, and husks of a cellulose fiber source such as corn, switchgrass, sorghum, rice straw, wheat, soybean, cotton, and barley to yield natural cellulosic fiber bundles therefrom that are preferably suitable for a variety of applications including textiles and fiber reinforced composites. Such fiber bundles themselves are another aspect of the present invention. In fact, it has been discovered that selecting or controlling one or more parameters of the method of the present invention allows for one or more physical properties (e.g., length, strength, elongation, and other properties) of the resulting fiber bundles to be controlled, modified, customized, or tailored depending on their desired end use.

Yet another aspect of the present invention is directed to the end use application of such fiber bundles. For example, the present invention is also directed to textiles that comprise the natural cellulosic fiber bundles. A specific textile example is that the fiber bundles of the present invention may be processed according to any conventional and appropriate method to produce yarns that comprise the fiber bundles (e.g., between about 10% to about 100% by weight of the fiber bundles). Such yarns may be used to make a variety of products. Alternatively, fiber bundles of the present invention may be used to make textiles without being transformed into yarn (e.g., non-woven textiles). Advantageously, the fiber bundles of the present invention may be processed like any other natural cellulosic fiber. Thus, the fiber bundles or products comprising or made from them may be bleached, mercerized, dyed, or a combination thereof according to a variety of known methods. The fields in which such textile-related products may be used include apparel, industrial uses, and medical uses. Another application for the fiber bundles of the present invention is fiber reinforced composite structures. For example, the fiber bundles of the present invention may be used in fiber reinforced plastics and foams, non-woven filters, and mats using the fiber bundles as 100% or as blends with other natural and/or synthetic fibers in ratios ranging from about 5 to about 95%.

1. Producing Natural Cellulosic Fibers

As set forth above, one aspect of the present invention is a novel method of extracting natural cellulosic fiber bundles from a cellulosic fiber source such as cornhusk. Preferably, the method of the present invention is carried out such that the resulting fiber bundles are suitable for textile application. It is important to note that although the present description is focused on treating cornhusk, the method of the present invention is not limited to extracting fibers from cornhusk. In fact, it is expected that the method of the present invention may be suitable for extracting fibers from other cellulosic fiber sources such as stem, leaf, shell, and floss from sugarcane, kenaf, coir, sorghum, pineapple, banana, dogbane, and milkweed, as appropriate.

a. Cellulosic Fiber Sources i. Cornhusk

Conventional natural cellulosic fiber materials (excepting cotton and kapok) are multicellular and to be useful they typically are in the form of groups of individual cells known as fiber bundles, rather than as individual cells. Likewise, cornhusk cellulose fiber bundles are multicellular and their individual cells are generally considered to be too small to be useful for textile and other industrial applications. The ultimate fibers, also referred to as "single cells" or "individual cells," in cornhusk are about 0.5 mm to about 1 mm in length and about 20 μm in width. Lignin, hemicellulose, and other binding substances bind individual cells into a fiber bundle suitable for textile and other industrial applications. Typically, fiber bundles are obtained from larger vascular bundles in plants by partially removing lignin and other constituents such as hemicellulose, pectin, and wax by retting (see above).

Individual cells in cornhusk are ribbon-like and twisted along their length with periodic reversal in the direction of twists, and tapered ends, similar to a cotton fiber, but much smaller than a cotton fiber. These natural convolutions increase the fiber-to-fiber contact and increase the cohesiveness, which is a desirable property for spinning fibers. FIG. 1*a* is a SEM image of an individual or a single cell of cellulose in cornhusk obtained by maceration; the individual cell has a smooth and clean surface because most of the binding materials have been removed. This single cell had a length of about 0.3-0.4 mm and a width of about 15-20 μm. FIG. 1*b* is a SEM image of the surface of an untreated cornhusk strand that was mechanically removed from the husk; the strand is rough with a thick layer of protective material and cellular deposits. Individual cells are held together by lignin, hemicellulose, pectin, and other binding materials within this layer. FIG. 1*d* is a light microscope image of a cross-section of a cornhusk showing a vascular bundle of fibers within encrusting substances.

The method of the present invention breaks down at least a portion of this protective layer and the binding materials to obtain fiber bundles with desired properties. FIG. 1*c* is a SEM image of a cornhusk fiber bundle of the present invention obtained after performing the method of the present invention. FIG. 1*e* is an image of a cross-section of a cornhusk fiber bundle of the present invention obtained after performing the method of the present invention. Both images of the fiber bundles show single cells that are held together by lignin and other substances and a fiber bundle with an irregular surface. It is the extent of removal of the binding materials, which may be varied by controlling or selecting the extraction conditions, that is believed to determine the fineness or width of the fiber bundles, structure, and other properties of the cornhusk fiber bundles. An interesting feature of the fiber cells in cornhusks is the presence of a large lumen, larger than the width of the cell wall in most cells, reducing the bulk density and perhaps increasing the absorbency of the fibers. Additionally, the large lumen provides a hollow region that acts as a thermal and air insulator. This property may make corn fiber bundles useful in fiber reinforced composites that are designed to act as thermal and air insulators in automobiles and other applications.

In accordance with the present invention, cornhusks from any variety of corn plants, grown under any climatic conditions may be used as a source for natural cellulose fiber bundles. Further, the method of the present invention may be performed on undried or green husk or dried husk. Preferably the cornhusk is dried before the treatment. If the cornhusks are unusually dirty, the method of the present invention may include washing the husks with an appropriate solvent (e.g., water) to remove impurities, foreign matter, and other materials soluble or partially soluble in the solvent before performing the remainder of the method of the present invention.

The cellulosic fiber bundles in cornhusks (i.e., the vascular fiber bundles) typically have a length that is between about 2 and about 20 centimeters. Depending on the intended use for the extracted fiber bundles, they may be segregated based on their length and used as such. Alternatively, the length may be controlled or selected by, for example, cutting, shearing, tearing, sawing, or any other appropriate way of dividing or separating fibers into smaller lengths. Advantageously, this ability to select or determine the length of the fiber bundles allows for cornhusk to be a source of fiber bundles suitable for both short and long staple spinning systems.

Conventionally, fiber bundles with a length of at least about 12 cm are processed as long staple fiber bundles, whereas fiber bundles with a length of at least about 2 cm and less than about 12 cm are processed as short staple fiber bundles. For example, if it is desired for the extracted fiber bundles to be processed using a cotton spinning system, it is desirable for the extracted fiber bundles to have a length that is similar to that of cotton fibers (between 1.5 and about 5.5 cm), and, as such, the extracted fiber bundles may be cut to have lengths between about 2 and about 3 cm. This dividing or separating may be performed at essentially any point in time. In one embodiment of the present invention, the fiber bundles are cut before being extracted from the husk. In alternative embodiments, the fiber bundles are cut at any point during the extraction process or after the extraction process is complete. In addition to mechanically dividing or separating fiber bundles, the length of fiber bundles may be controlled by the extraction process. Specifically, relatively stronger or harsher treatment conditions tend to produce a larger percentage of fiber bundles suitable for short staple processing.

ii. Switchgrass

Like cornhusk, switchgrass cellulose fiber bundles are multicellular and their individual cells are generally considered to be too small to be useful for textile and other industrial applications. FIGS. 3*a* and 3*b* are SEM images of a longitudinal view of individual cells obtained from switchgrass stem material and leaf material. Individual cells are obtained by removing binding material such as lignin and hemicellulose. Individual cells from switchgrass stems and leaves tend to be circular with tapered ends and smooth surfaces. Depending on the species of switchgrass, the individual cells are less than 1 mm to about 4.2 mm in length. The lengths of individual cells from switchgrass leaves and stems are longer than those found in lignocellulosic agricultural byproducts such as cornstover, wheat and rice straws, but shorter than individual cells in bast fibers such as flax and ramie. Individual cells from cornstover, wheat and rice straws range from about 0.5 to 1.5 millimeter in length whereas individual cells from flax bast may have lengths of several centimeters. Switchgrass individual cells typically have widths of about 7 μm, which is similar to individual cells from flax but narrower than widths found in most natural cellulose fiber sources. In switchgrass, lignin, hemicellulose, and other binding substances bind individual cells into a fiber bundle. The presence of lignin and other binding materials may, however, affect the properties and processability of the fiber bundles. For example, lignin imparts a natural color that is difficult to remove by normal bleaching methods and also increases the light and thermal degradation of the fiber bundles.

FIGS. 3*c* and 3*d* are SEM images showing a longitudinal view of the surface of an untreated switchgrass stem and untreated switchgrass leaf. The surface of untreated switchgrass stems and leaves have deposits similar to other grasses and lignocellulosic materials (i.e., it is composed mainly of lignin and hemicellulose). As summarized in Table B, the make-up of switchgrass leaf and stem are, however, significantly different. For example, the stems typically contain about ten percent more cellulose than leaves. Also, switchgrass leaf fiber bundles obtained after performing the method of the present invention have higher amounts of lignin and ash.

TABLE B

Composition of untreated leaves and stems and leaf and stem fiber bundles from Switchgrass obtained after performing the method of the present invention.

| Material | Cellulose | Lignin | Ash |
|---|---|---|---|
| Untreated | | | |
| Leaves | 41.4 | 27.1 | 1.0 |
| Stems | 50.8 | 21.8 | 3.2 |
| Fiber Bundles | | | |
| Leaves | 61.2 | 25.1 | 3.3 |
| Stems | 68.2 | 9.1 | 1.9 |

As shown in FIGS. 4*a* and 4*b*, the method of the present invention yields high quality natural cellulose fiber bundles having a clean and smooth surface with the length, width, strength, elongation and other properties necessary for textile and other applications. Moreover, switchgrass fiber bundles obtained using the method of the present invention do not have convolutions characteristically observed in cotton or intermittent nodes observed in bast fibers. As summarized in Table C, the percent crystallinity of switchgrass leaf fiber bundles is similar to the crystallinity found in cotton and flax. Switchgrass stem fiber bundles tend to have a lower crystallinity (similar to cornhusks, cornstalks, and rice straw fiber bundles). Switchgrass stem fiber bundles have relatively low crystallinity similar to that in cornhusks, cornstalks, and rice straw fibers. Switchgrass stem and leaf fiber bundles have a slightly different arrangement of cellulose microfibrils and cellulose crystals along the axis of the fiber bundle as indicated by the multifibrillar angle ("MFA") and crystallinity index ("CI"), respectively. A lower MFA indicates that the cellulose microfibrils are well arranged along the fiber bundle axis. Fiber bundles with lower MFA tend to have relatively lower elongation values. A lower CI indicates little orientation of the cellulose crystals along the fiber bundle axis. Fiber bundles with a lower CI tend to have lower fiber bundle strength. Switchgrass leaf fiber bundles tend to have a lower MFA but higher CI than switchgrass stem fiber bundles. Therefore, switchgrass leaf fiber bundles tend to have a lower elongation and higher fiber bundle strength than switchgrass stem fiber bundles.

TABLE C

Morphological and physical structure of fiber bundles from Switchgrass leaf and stem compared with flax and cotton.

| | Leaf | Stem | Flax | Cotton |
|---|---|---|---|---|
| Morphological structure | | | | |
| Single cell length (mm) | 2.9 ± 1.3 | 2.4 ± 1.4 | 4–77 | 15–56 |
| Single cell width (μm) | 7 ± 1.3 | 7.3 ± 3.6 | 5–76 | 12–25 |
| Physical structure | | | | |
| Crystallinity (%) | 65 | 46 | 65–70 | 65–70 |
| MFA (degree) | 11 | 15 | 6–10 | 20–25 |
| CI | 68 | 61 | 70 | 70 |

Figure 5:
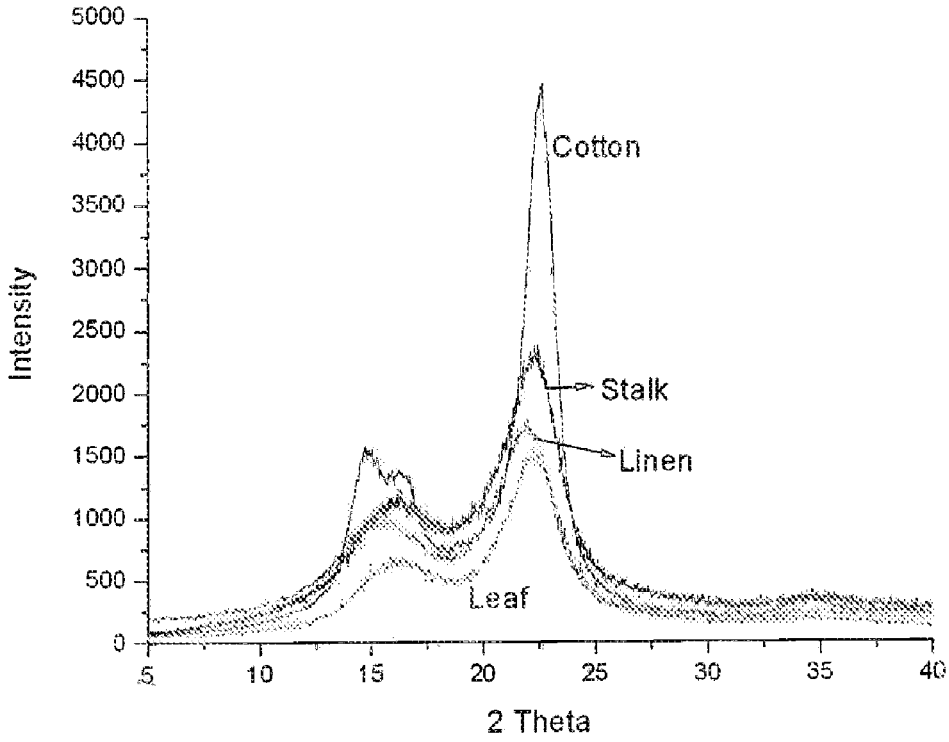
FIG. 5 is a comparison of X-ray diffraction patterns of fiber bundles from switchgrass stem, switchgrass leaves, cotton, and linen.
Figures 6, 6A, 6B:
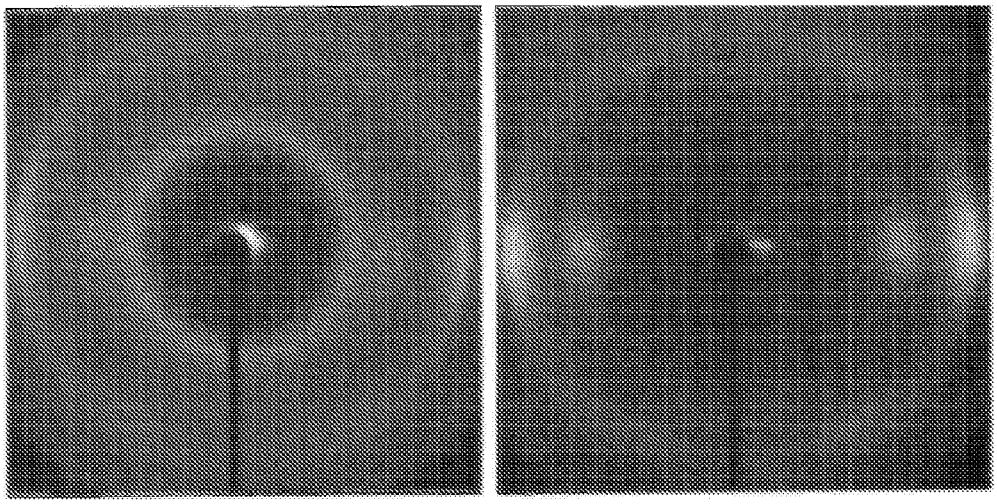
FIG. 6 is X-ray diffraction patterns of switchgrass fiber bundles.
FIG. 6*a* is an X-ray diffraction pattern of switchgrass stem fiber bundle.
FIG. 6*b* is an X-ray diffraction pattern of switchgrass leaf fiber bundle.

As shown in FIG. 5, the switchgrass leaf and stem fiber bundles have similar diffraction patterns but the peaks are broader and less intense than those obtained from cotton. The characteristic 101 and 101 peaks found in cotton are not distinct in the switchgrass fiber bundles, as similarly observed for flax (linen), but have combined to form a broad peak. This broadening of the peaks is mostly due the presence on non-cellulosic materials in the fiber bundles and due also to the smaller crystal size in the switchgrass fiber bundles. The diffraction pattern of switchgrass stem fiber bundles, as shown in FIG. 6*a*, are broad, diffuse, and long indicating the cellulose in the fiber bundles is poorly oriented and the cellulose crystals are relatively large in size. Cellulose in switchgrass leaf fiber bundles however, is well oriented as indicated by the bright, sharp and short diffracting arcs observed in FIG. 6*b*.

iii. Sorghum

The length of individual cells in sorghum leaf and stem are about 1.7 and about 1.3 mm, respectively. The length of individual cells in sorghum leaves and stems are shorter than those found in the common bast fibers such as linen and ramie but similar to those of cornstover, rice straw and wheat straw. The widths of individual cells in sorghum leaf and stem are about 15 and 18 μm, respectively. The width of the individual cells in sorghum is similar to cornstover but greater than rice straw and switchgrass. The relatively shorter and wider individual cells in sorghum tends to result in fiber bundles that are coarser than those obtained from rice straw and switchgrass.

As summarized in Table D, sorghum leaf and stem fiber bundles have similar cellulose content but leaf fiber bundles have a higher lignin and ash content than stem fiber bundles. The difference in composition of the leaf and stem fiber bundles may be attributed to inherent variations of sorghum leaves and stems. Since the leaves are the outer most layer of the sorghum plant and they cover the stems as well, there will be higher lignin and ash in the leaves to protect the inner parts of the plants. Also, the relatively milder extraction conditions used on leaf material results in higher lignin and ash in leaf fiber bundles than in stem fiber bundles.

TABLE D

Composition of the fiber bundles obtained from sorghum leaves and stems.

| Material | Cellulose | Lignin | Ash |
|---|---|---|---|
| Leaves | 64.8 | 9.0 | 2.9 |
| Stems | 65.1 | 6.5 | 1.2 |

Figure 7:
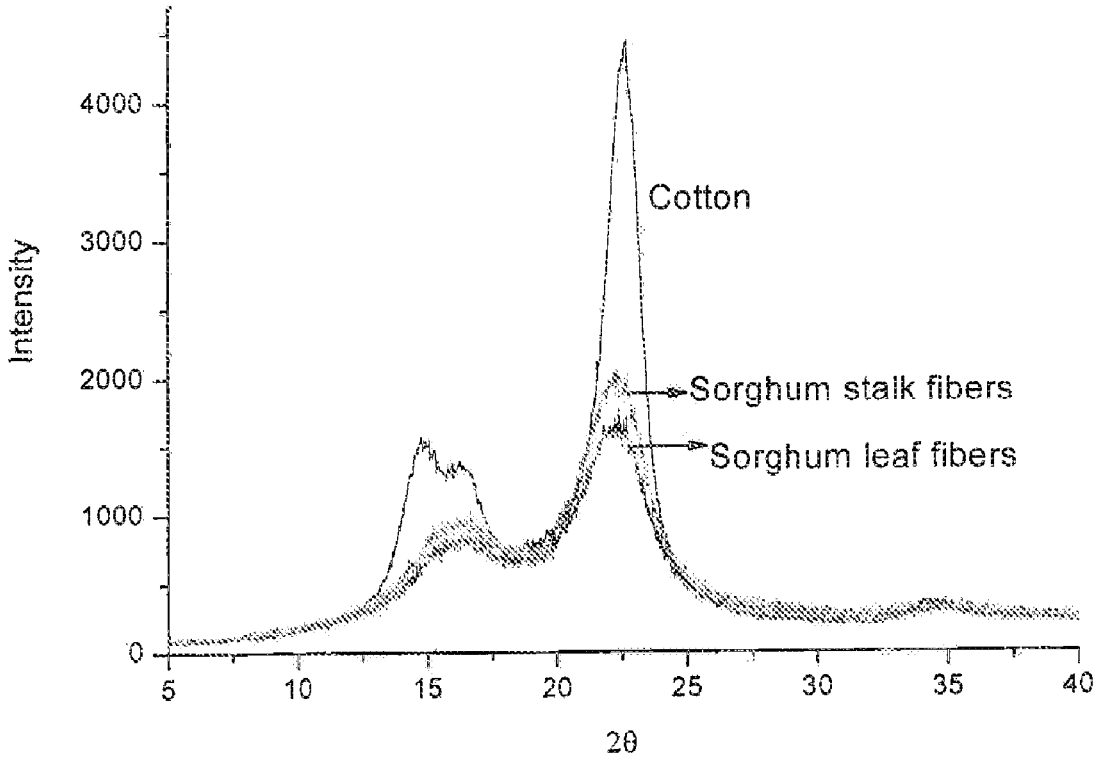
FIG. 7 is a comparison of X-ray diffraction patterns of fiber bundles from sorghum stem and leaf.

The percent crystallinity of the sorghum leaf fiber bundles is lower than the crystallinity found in cotton, linen and other lignocellulosic fiber bundles such as cornhusks, cornstalks and rice straw fiber bundles. As shown in FIG. 7, sorghum leaf and stem fiber bundles have similar diffraction patterns but the peaks are broader and less intense than cotton. The characteristic 101 and 101 peaks for cotton are not distinct for sorghum fiber bundles, as similarly observed for linen. The two peaks have combined forming a broad peak. This broadening of the peaks for the sorghum fiber bundles is likely attributed to the presence of non-cellulosic materials and also to a smaller crystal size.

TABLE E

Comparison of morphological and physical structure of sorghum leaf and stems fiber bundles with linen and cotton.

| | Leaf | Stem | Linen | Cotton |
|---|---|---|---|---|
| Morphological structure | | | | |
| Single cell length (mm) | 1.7 ± 0.8 | 1.3 ± 0.7 | 4–77 | 15–56 |
| Single cell width (μm) | 15 ± 2.3 | 18 ± 2.7 | 5–76 | 12–25 |
| Physical structure | | | | |
| Crystallinity (%) | 32 | 39 | 65–70 | 65–70 |
| MFA (degree) | 15.5 | 16.5 | 6–10 | 20–25 |
| CI | 56 | 81 | 70 | 70 |

FIGS. 8*a* and 8*b* are diffraction patterns showing arrangement of cellulose crystals along the fiber bundle axis. The diffraction patterns of sorghum stem and leaf fiber bundles are sharp, but relatively broad indicating that the cellulose in the fiber bundles is well oriented but that the cellulose crystals are relatively large in size.

iv. Rice Straw

Rice straw generally contains about 35% cellulose, 30% hemicellulose, 15% lignin and about 20% ash. Rice straw may also contain about 3 to about 14% silica. The cellulose fiber bundles in rice straw are interconnected to each other to form large bundles with the widths of hundreds of micrometers to millimeters. They are then connected to each other by films. The ultimate fibers in rice straw are about 0.4 to 1.0 mm in length.

TABLE F

Composition of rice straw fiber bundles.

| | Cellulose | Lignin | Ash | Other |
|---|---|---|---|---|
| Rice straw | 62–68 | 8–12 | 3.5–26.5 | 15–26.5 |

The percent crystallinity of rice straw fiber bundles is between 62 and 63.5%, which is similar to flax (linen) (65%), but higher than that in cornhusk, cornstalk and pineapple leaf fiber bundles which have about 50% crystallinity. The diffraction pattern of rice straw fiber bundles is sharp and short indicating that the cellulose is well oriented and cellulose crystals are relatively small in size. As summarized in Table G, rice straw fiber bundles obtained according to the present invention have a lower CI but higher MFA than linen. For example, rice fiber bundles generally have a CI value ranging between 55 and 60 compared to that of flax (linen) with a CI value of 70. In contrast, rice straw fiber bundles generally have a MFA value ranging from 18° to 22° while flax (linen) generally has a MFA value ranging from 6° to 10°.

TABLE G

Comparison of morphological and physical structure of rice straw fiber bundles with flax and cotton.

| | Rice Straw | Flax (linen) | Cotton |
|---|---|---|---|
| Morphological structure | | | |
| Single cell length (mm) | 0.4–1.0 ± 1.3 | 4–77 | 15–56 |
| Single cell width (μm) | 7 | 5–76 | 12–25 |
| Physical structure | | | |
| Crystallinity (%) | 62–63.5 | 65–70 | 65–70 |
| MFA (degree) | 18–22 | 6–10 | 20–25 |
| CI | 55–60 | 70 | 70 |

v. Wheat Straw

As summarized in Table H, wheat straw has similar cellulose and hemicellulose contents as rice straw and has a lignin content in the range of 17-19% and an ash content in the range of about 6 to 8%. Additionally, wheat straw typically comprises wax primarily on its surface; the relative amount of dry wax is usually about 3%.

TABLE H

Composition (% on dry weight) of the wheat and rice straw fibers.

| Component, % | Wheat straw fibers | Rice straw fibers |
|---|---|---|
| Cellulose | 64.8 | 64 |
| Lignin | 9.0 | 8 |
| Ash | 2.9 | 5 |

The physical structure of wheat straw fibers in terms of percent crystallinity, MFA and CI are compared with that of rice straw fibers in Table I. As indicated therein, the wheat straw fibers usually have lower percent crystallinity but similar CI compared to rice straw fibers. The cellulose crystals in wheat straw fiber bundles appear to be well oriented along the fiber axis as indicated by the CI. Since wheat straw fiber bundles usually have similar cellulose content as the rice straw fiber bundles, the lower crystallinity of the wheat straw fiber bundles suggests that the fiber bundles may have a lower strength but greater moisture and chemical absorptions than rice straw bundles. Also, wheat straw fiber bundles have similar lengths but are much coarser than the rice straw fiber bundles, which is believed to be most likely due to the relatively shorter and wider width single cells in wheat straw.

TABLE I

Morphology and physical structure of wheat straw fiber bundles compared with rice straw fiber bundles. Errors are ±one standard deviation.

| Component | Wheat straw fibers | Rice straw fibers |
|---|---|---|
| Single cell dimensions | | |
| Length, mm | 0.3–1.1 | 0.6 ± 0.2 |
| Width, μm | 10–14 | 8.1 ± 1.4 |
| Physical structure | | |
| Crystallinity, % | 48 | 63 |
| MFA, deg | — | 19 |
| CI | 64 | 57 |

vi. Soybean

Soybean straw fibers have percentage crystallinity and microfibrillar angle similar to that of fibers obtained from other agricultural byproducts but lower than that in cotton. The lower percent crystallinity of soybean straw fibers compared to cotton and other common bast fibers suggests that the soybean straw fibers may have good moisture absorption and dye uptake. The MFA of soybean straw fibers tends to similar to that of the common bast fibers such as linen but lower than that of cotton, which is typically in the range of 20-25°. Based on the MFA, soybean straw fibers may have an elongation similar to that of the linen but lower than that of cotton. The CI of soybean straw fiber bundles is usually higher than that of cotton but lower than that of flax, which suggests that the cellulose crystals in the soybean straw fiber bundles are more oriented along the fiber axis than those of cotton but are less oriented than those of flax.

TABLE J

Composition of soybean straw fiber bundles.

| | Soy Straw |
|---|---|
| Single cell dimensions | |
| Length, mm | 1.5 ± 0.5 |
| Width, μm | 15.6 ± 3.6 |
| Physical structure | |
| Crystallinity, % | 47 |
| MFA, deg | 12 |
| CI | 74 |

b. Extraction of Fiber Bundles

The method of extracting fiber bundles from source material of the present invention comprises, in general, performing an alkali treatment on source material, an enzyme treatment on source material, or both treatments to break down, or decompose lignin and any other materials or films connecting the cellulose fibers in the source material, or cellulose itself. Preferably, the source material is subjected to both treatments. In such an embodiment, the enzyme treatment may be performed before, during, or after the alkali treatment, or a combination thereof. Both types of treatments preferably comprise contacting the source material with a solution comprising: an alkali compound that is at least partially soluble in the solute (preferably water), an enzyme compound that is at least partially soluble, or both. Although it is possible for the alkali and enzyme treatments to be performed concurrently (i.e., the alkali and enzyme compounds are in the same solution), this is generally not preferred. Preferably, the process comprises sequential treatments with one or more alkali-containing solutions and one or more enzyme-containing solutions. For example, in one embodiment the enzyme treatments comprises treating the source material with two enzyme solutions wherein the enzymes in the solutions are different. The method of extracting fiber bundles from source material of the present invention may also comprise an optional detergent treatment performed preferably prior to the alkali and/or enzyme treatments to remove surface wax on the source material that may provide resistance to alkali and/or enzyme treatment.

The break down of lignin and other materials or films is controlled so that the cellulose fibers of the source material (i.e., vascular or coarse fibers) are partially delignified to yield the cellulosic fiber bundles of the present invention that are finer than the vascular fibers, but longer than ultimate cells. Preferably, the cellulosic fiber bundles of the present invention are of a fineness and length suitable for textile applications. In other words, the break down is controlled so that a substantial portion of the vascular or coarse fibers are separated from the source material (e.g., husk, stem, leaf, straw, etc.) without being reduced to non-bound ultimate fibers or individual cells. It is believed that the method of the present invention may yield up to about 30% by weight of the source material in the form of extracted fiber bundles, which may be described as "long fibers," that comprise a multiplicity, a group, or a bundle of connected ultimate fibers or individual cells. For example, fiber bundles with lengths between about 1.5 and about 23 cm having linear densities between about 10 and about 140 denier have been obtained with the method of present invention. Typically, the method of the present invention is carried out so that the length of the fiber bundles or long fibers is between about 1.5 and about 20 cm. At a minimum, however, they are longer than an individual cell, which is typically between about 0.4 and about 3.5 mm in length.

i. Alkali Treatment

The alkali treatment comprises contacting or mixing source material (e.g., precut, uncut, pre-treated source material (i.e., source material previously treated with an alkali treatment or an enzyme treatment) or untreated source material, or a combination thereof) with an alkali compound. Although the alkali compound may be anhydrous, it is preferably dissolved in a solvent (i.e., a solution comprising an alkali compound (an "alkali solution")). The alkali solution may be aqueous or non-aqueous. The source material is partially delignified as described above by controlling or selecting one or more parameters associated with the alkali treatment. A list of such exemplary parameters includes the concentration of alkali in the solution, the temperature of the mixture (e.g., preferably less than 100° C.), the ratio of alkali solution to source material (also referred to as the liquor-to-solid ratio), the duration the alkali solution and source material are in contact, and the pressure at which the solution and source material are in contact. These parameters are generally interrelated, for example, the duration of treatment tends to depend on the concentration of alkali and the temperature at which the treatment is carried out. In general, it has been discovered that shorter treatment times at higher temperatures and concentrations are preferred for practical reasons and for commercial application.

In one embodiment, the alkali treatment comprises contacting or mixing the source material, precut or not, or pretreated (with alkali or enzyme) with an aqueous alkali solution having a normality that is between about 0.05 and about 2.5 N (the concentration may be as high as about 10 N) to form a mixture having a liquor-to-solid ratio that is between about 1:1 and about 100:1 that is maintained within the temperature range of about 60 to about 100° C. (the temperature may be as low as just above the freezing point to just below the boiling point). Preferably, the source material and alkali solution are in contact for a duration of about 15 to about 90 minutes (the duration may be as long as 7 days or longer).

It should be noted that the alkali solution may comprise "strong" alkalies such as alkaline metal or alkaline-earth metal hydroxides, "weak" alkalies such as alkaline metal or alkaline-earth metal carbonates, or a combination thereof may be used. Depending on the strength of the alkali solution, however, it is generally desirable to adjust the other alkali treatment parameters as appropriate to ultimately partially delignify the source material and extract the desired fiber bundles. For example, if the alkali solution comprises, largely, strong alkali compounds such as sodium hydroxide, the treatment conditions are preferably such that the normality of the solution is between about 0.1 and about 1.0 N, the temperature is between about 60 and about 100° C., the duration is between about 15 and about 45 minutes, and the liquor-to-solid ratio (volume of solution to weight of solid) is between about 5:1 and about 50:1. Alternatively, the relationship between liquor or solution may referred to as a percentage of solid (i.e., weight of solid/volume of liquor or solution). More preferably, the solution's normality is about 0.3 N, the temperature is about 95° C., the duration is about 30 minutes, and the liquor-to-solid ratio is about 15:1. If weak alkalies, such as sodium carbonate, are used, treatment conditions of about 1 to about 2 N at boil for about 40 to about 90 minutes are preferable. More preferably, the solution's normality is about 1.5 N, the solution is maintained at the boiling point, the duration is about 70 minutes, and the liquor-to-solid ratio is about 15:1.

It should be noted that the extraction process, including the alkaline and enzyme treatments, is preferably performed at atmospheric pressure. The process of alkaline extraction may be carried out in any appropriate container. Preferably, the container is closed under atmospheric conditions, but an open container may be used. Further, the solutions and mixtures may be heated using any appropriate method. Preferably, the extraction process is carried out using equipment having precise temperature control.

After the treatment is complete, the solid portion and liquid portion of the mixture are preferably separated by any appropriate method such as straining or filtration. The liquid portion may be treated to remove compounds dissolved or removed from the source material to yield a purified alkali solution that may be reused for further extraction. This reduces the disposal problems and would also help reduce the cost of extraction. The solid portion, although not required, may be rinsed with water (preferably cold water). Washing is preferably continued until essentially all of the dissolved lignin and other materials are removed. No special washing apparatus is required. Washing can be done in any suitable way so as to easily remove the impurities and dissolved substances, while ensuring that the fiber bundles are not washed away. After washing, the fiber bundles are preferably subjected to an optional removal of excess water by any appropriate method (e.g., centrifuge or vacuum slot).

Additionally, the solid portion, preferably after being rinsed, may be treated with an acidic solution to neutralize any remaining alkali. Like rinsing, this neutralization step is optional. In general, any remaining alkali will be neutralized with a dilute acid solution, for example, an acetic acid solution. If acetic acid is used, the acid concentration may be between about 10% and about 30%, preferably about 10% (the acid concentration may be as low as about 1%), and the liquid-to-fiber bundle ratio is preferably at least about 5:1 and more preferably about 10:1. The neutralized fiber bundles are preferably rinsed in water and the excess water removed as described above.

The solid portion may be dried at any point or points during or after the extraction process. Preferably, the fiber bundles are at least dried after the extraction process is complete. The drying of fiber bundles can be carried out at ambient temperature or at higher temperature using any appropriate device or method such as hot air ovens and infrared driers. The drying time depends on the extent of moisture desired in the fiber bundles. It is preferred that after the extraction process is complete, the fiber bundles are dried so that they are dry-to-the-touch to reduce or avoid bacterial and fungal decomposition due to the presence of moisture.

ii. Enzyme Treatment

The enzyme treatment comprises contacting or mixing the source material, precut or not, or pre-treated (with alkali or enzyme), with one or more enzymes selected to degrade lignin, hemicellulose, cellulose, or a combination thereof. Examples of such enzymes include xylanase-type enzymes and cellulase-type enzymes. Such types of enzymes are commercially available from Novozymes of Franklin, N.C. For example, PULPZYME is a xylanase-type enzyme that, without being held to a particular theory, is believed to depolymerize hemicellulose and break the covalent link between lignin and carbohydrates. The depolymerized hemicellulose and separated lignin may be removed by washing. Cellulases are enzyme complexes that generally comprise three main units: endoglucanases, cellobihydrolases, and β-glucosidases. It is believed that endoglucanases attack the cellulose chains at random, cellobiohydrolases hydrolyze the cellulose chains from the nonreducing end, and β-glucosidases hydrolyze the cellulobiose into glucose. Cellulases may be used to remove short fibers that are not suitable for textile applications. In general, the source material is treated with one or more enzymes (i.e., subjected to the enzyme treatment) to improve the fineness of the extracted fiber bundles, mechanical properties of the fibers bundles, or both.

As with the alkali treatment, enzyme treatment parameters (e.g., concentration, time, temperature) affect the degree of delignification, and, as a result, they are preferably selected or controlled so as not reduce the fiber bundles from the source material to primarily ultimate fibers. This is especially important for cellulases because they are capable of damaging the cellulose in the fiber bundles resulting in decreased fiber strength.

In one embodiment, the enzyme treatment comprises contacting or mixing the source material, precut or not, or pre-treated (with alkali or enzyme), with one or more solutions comprising one or more enzymes (i.e., "enzyme solutions") having an enzyme concentration that is between about 0.01 and about 10% (w/v) (the enzyme concentration may be as high as about 50%) for a duration that is between about 1 and about 120 minutes. Preferably, the enzyme solution-to-solid ratio (liquor-to-solid ratio) is between about 1:1 and about 100:1. Preferably, the mixture of source material and enzyme solution is maintained between about 10 and about 75° C. More preferably, the concentration is between about 0.1 and about 1% (w/v), the duration is between about 10 and about 60 minutes, the liquor-to-solid ratio is between about 5:1 and about 20:1, and the temperature is between about 25 and about 65° C. These parameters are generally interrelated, for example, the duration of treatment tends to depend on the concentration of enzyme and the temperature at which the treatment is carried out. In one embodiment the source material is treated with an enzyme solution at a concentration of about 5%, the temperature is about 50° C., the duration is about 60 minutes, and the liquor-to-solid ratio is about 20:1. During the enzyme treatment, it is preferred for the mixture of enzyme solution and source material to have a pH that is between about 4 and about 6 (the pH may be as low as about 2).

In one embodiment the source material is subjected to an enzyme treatment that comprises a xylanase-type enzyme and a cellulase-type enzyme. In this embodiment, the enzyme treatment preferably comprises two separate sub-treatments: a treatment with a solution comprising the xylanase-type enzyme and a treatment with a solution comprising the cellulase-type enzyme. Preferably, xylanase-type enzyme treatment is performed before the cellulase-type enzyme treatment. In one embodiment, the extraction process comprises treating the source material with a xylanase solution, followed by an alkali solution, followed by a cellulase solution. In another embodiment, the extraction process comprises treating the source material with an alkali solution, followed by a xylanase solution, followed by a cellulase solution.

It should be noted that the experimental results to date indicate that using an alkali treatment without an enzyme treatment to extract fiber bundles from source material tends to yield fiber bundles that are relatively coarse and of lower-quality (e.g., decreased strength), or primarily small hydrolyzed ultimate fibers. Such coarse fiber bundles had deniers of about 180 and higher and were obtained using a relatively low concentration of alkali, shorter processing time, and lower temperature. The strength of these fiber bundles is typically low at about 1 gram per denier. Some of the possible reasons for the lower strength of the coarser fiber bundles are discussed below. In contrast, if higher alkali concentrations, and a longer treatment duration or higher temperature are used, most of the cellulose in the natural cellulosic source material tended to hydrolyzed into small ultimate fibers, and the fiber bundle yield tended to be low.

Experimental results to date also indicate that using only an enzyme treatment typically provides less than optimum results. Specifically, using enzymes alone makes breaking down the outside layer of protective material on the source material difficult. This difficulty tends to exist even over wide ranges of enzyme concentration, pH, treatment duration, and temperature. Because of this difficulty, using an enzyme treatment on source material without using an alkali treatment tends to remove the weak fibrous parts that connect the long thick strands of the source material, but the long thick strands of source material tend to retain a large portion, if not all, of their outer covering.

iii. Detergent Treatment

The detergent treatment comprises contacting or mixing the source material, precut or not, with one or more detergents selected to remove surface wax. Examples of such detergents include commercially available anionic, cationic and non-ionic detergents including but not limited to AATCC detergents, Tide, Gain and other commercial products. Such detergents are commercially available from manufacturers such as Procter and Gamble, Uniliver, and Henkel. The source material is subjected to a detergent solution having a detergent concentration that is between about 0.1 and about 25% (w/v). The source material is subjected to a detergent solution for a duration that is between about 5 and about 360 minutes. The source material is subjected to a detergent solution maintained within the temperature range of about 0 to about 100° C. The detergent treatment preferably comprises agitation of the source material while in contact with the detergent solutions such by, for example, manual agitation (hand washing) or mechanical, such as in a launderometer. Preferably, the detergent treatment comprises contacting the natural cellulosic source material with a detergent solution having a detergent at a concentration of about 0.2% for a duration of about 30 minutes at a temperature of about 70° C., wherein the detergent treatment is performed in a launderometer. Following detergent treatment, the source material may optionally be washed to remove the detergent solution prior to alkali and/or enzyme treatment.

As with the alkali and enzyme treatments, parameters (e.g., concentration, time, temperature) affect the degree of wax removal, and, as a result, they are preferably selected or controlled. As indicated above with respect to wheat straw, the detergent treatment is typically performed on cellulosic sources that comprise a waxy surface, which tends to hinder, reduce, delay, inhibit, or obstruct the alkali and/or enzyme treatment.

2. Natural Cellulosic Fiber Bundles

In addition to length, the fiber bundles extracted from cellulosic sources using the method of the present invention may be characterized using common textile properties. For example, the fineness of the fiber bundles may be characterized, for example, in denier by weighing a known length of fiber bundles. Fiber bundles of the present invention may have a fineness that is between about 1 and about 300 denier. Depending on the desired application, the fiber bundles may be as fine as, for example, 12 denier or finer. Alternatively, the process may be controlled such that the fiber bundles have a fineness, for example, between about 12 and about 120 denier. As mentioned above, however, long staple fibers typically have a fineness is between about 80 and about 140 denier. Essentially, the process of the present invention allows for a significant degree of flexibility or selection of the properties of the extracted fiber bundles depending on the desired end use.

a. Natural Cellulosic Fiber Bundles from Corn i. Cornhusks

In addition to length and fineness, the fiber bundles extracted from cornhusks using the method of the present invention may be characterized using other common textile properties. For example, corn fiber bundles may be characterized based on their strength (tenacity). In one embodiment the natural cellulosic fiber bundles of the invention have a strength of at least about 1 gram per denier. In another embodiment the strength is at least about 2 grams per denier. In another it is about 2.5 grams per denier.

The corn fiber bundles may be characterized based on their elongation percentage. In one embodiment the fiber bundles have an elongation of at least about 2%. In another the elongation is at least about 5%. In another the elongation is at least about 10%. Fiber bundles have a regain of about 9% at 65% relative humidity and 95° F. In yet another embodiment the elongation percentage is between about 9 and about 12%. Still further, the elongation percentage may be up to about 18%.

Still further, the corn fiber bundles may be characterized based on their moisture regain. Moisture regain tends to be important for fiber processing and for comfort during wear. In one embodiment the fiber bundles have a moisture regain that is between about 8.5 and about 9.5%. In comparison, the moisture regains of cotton and wool are about 8 and 16%, respectively.

The mechanical properties of textile fibers—the responses to applied forces and deformations—are particularly important properties for selecting fibers because they affect the behavior of the fibers during processing and to the properties of the final product. A comparison of some extracted corn fiber bundles and conventional natural textile fibers is summarized in Table K.

TABLE K

Comparison of Some Fiber Properties between Cornhusk and Other Common Fiber Sources.

| Fiber or Fiber Bundle | Length (cm) | Denier | Tenacity (g/den) | Breaking Elongation (%) | Color |
|---|---|---|---|---|---|
| Ramie[1] | 10–180 | 4.6–6.4 | 7.3 | 4.0 | Off-White |
| Hemp[1] | 100–300 | 3.0–20 | 6.3 | 1.0–6.0 | Grey |

TABLE K-continued

Comparison of Some Fiber Properties between Cornhusk and Other Common Fiber Sources.

| Fiber or Fiber Bundle | Length (cm) | Denier | Tenacity (g/den) | Breaking Elongation (%) | Color |
|---|---|---|---|---|---|
| Flax[1] (Linen) | 20–140 | 1.7–17.8 | 5.8 | 2.0–3.0 | Grey |
| Jute[1] | 150–360 | 13–27 | 3.2 | 0.9–1.17 | Brown |
| Cotton[1] | 1.5–5.5 | 1.0–3.3 | 2.7 | 6.0–9.0 | Off-white |
| Wool[1] | 3.0–7.0 | 15.0 | 2.1 | 30.0–40.0 | Yellowish |
| Sisal[1] | 75–120 | 42.0 | 5.3 | 2.0–3.0 | Brown |
| Kenaf[2] | 200–400 | 50.0 | 3.0 | 2.0–6.0 | Dark Brown |
| Pineapple[3] | 55–75 | 23.0–34.0 | 2.5 | 2.7–3.2 | Golden yellow |
| Coir[1] | 15–20 | 30.0–200.0 | 2.0 | 16.0–30.0 | Dark Brown |
| Sugarcane[4] | 2.5–5.0 | 200–400 | 2.5 | 5.5–10.3 | Yellowish |
| Cornhusk | 2–20 | >12.0* | 2.5 | 9.0–12.0 | Yellowish |

*For a specific condition as disclosed in Example 8.
[1]Handbook of Fiber Chemistry (1998).
[2]Paper and Composites from Agro-Based Resources (1996).
[3]Indira Doraiswamy (1993).
[4]Billie J. Collier (1992).

The physical properties and the appearance of the cornhusk fiber bundles tend to be in-between those of cotton and flax, two of the most widely used cellulose fibers in the world. For textile applications, strength of at least 1 gram per denier is preferred with an elongation of at least 2%. Cornhusk fiber bundles tend to have higher breaking elongation than cotton and other natural cellulosic fibers. The higher elongation is believed to be useful for processing and increase comfort during wear. It is expected that these cornhusk fiber bundles will provide unique and desirable properties to textiles when blended with other fibers, especially synthetics. From Table K, it is evident that fiber bundles from cornhusk meet the basic requirements for textile fibers.

Advantageously, the cornhusk fiber bundles of the present invention may be processed according to conventional textile processing methods. For example, they may be subjected to conventional beaching and spinning operations just as any other natural cellulosic fiber. Further, the cornhusk fiber bundles of the present invention may be processed to make textiles including yarns that are made entirely of husk fiber bundles or the husk fiber bundles may be blended with any other desired fiber (e.g., wool, cotton, linen, polyester, etc.).

ii. Cornstalks

The fiber bundles may also be obtained from cornstalk using the method of the present invention. Fiber bundles obtained from cornstalks have fineness (denier) similar to that of kenaf which has denier of about 50. Cornstalk fiber bundles typically have a strength ranging from about 1.5 to about 4.5 grams per denier. The fiber bundles cornstalk have strength properties that encompasses what is typically observed with kenaf (about 1.5 to about 2.5 grams per denier) and cotton (about 3.5 grams per denier). The elongation of cornstalk fiber bundles (about 2.2 to about 3.5%) is similar to that of flax (2 to 3%) but lower than that of kenaf (3.5 to 5.5%) and cotton (6 to 10%). Cornstalk fiber bundles have an MFA of about 10°. The modulus of cornstalk fibers is typically at about 127 grams per denier, which is between that of flax (200) and cotton (50). The lower modulus of cornstalk fiber bundles than flax suggests that products made from cornstalk fiber bundles may be more flexible and soft to the hand than products from flax. The moisture regain of cornstalk fiber bundles typically is about 7.5%, which is similar to cotton but less than flax (12%) and kenaf (17%). Having moisture absorption similar to cotton suggests that products made from cornstalk fiber bundles should be comfortable to wear. Regarding the durability of cornstalk fiber bundles as measured in terms of the work of rupture, they tend to have a work of rupture similar to kenaf (about 0.03 grams per denier) but lower than that of cotton (0.13 grams per denier) and flax (0.09 grams per denier). Overall, the mechanical properties of cornstalk fiber bundles in terms of the denier, strength, elongation, and modulus are similar to that of kenaf. Therefore, cornstalk fibers may also be suitable for processing on the conventional textile machinery and also for blending with the other common fibers.

b. Natural Cellulose Fiber Bundles from Switchgrass

The fiber bundles may also be obtained from switchgrass using the method of the present invention. For example, fiber bundles from switchgrass leaf and stem have been produced having various properties as set forth in Table L.

The physical properties and the appearance of the switchgrass fiber bundles tend to be intriguingly similar to cotton and flax. As summarized in Table L, switchgrass leaf fiber bundles were finer, longer, and stronger than switchgrass stem fiber bundles. Switchgrass stem fiber bundles, however, were more extensible and less stiff than switchgrass leaf fiber bundles. Although these switchgrass stem fiber bundles had a lower strength than the leaf fiber bundles, they may be more durable than the switchgrass leaf fiber bundles due to their higher elongation and lower modulus as indicated by their higher work of rupture value. Switchgrass stem and leaf fiber bundles have similar moisture regains that are close to that of cotton, but lower than the regain of flax (linen). It is expected that these switchgrass fiber bundles will provide unique and desirable properties to textiles when blended with other fibers, especially synthetics.

TABLE L

Comparison of fiber bundle properties from Switchgrass Leaf and Stem, Cotton, and Flax.

| Fiber property | Leaf | Stem | Flax (Linen) | Cotton |
|---|---|---|---|---|
| Fineness (denier) | 18–42 | 32–107 | 1.7–17.8 | 1–3.3 |
| Length (cm) | 2–12 | 2–8 | 20–140 | 1.5–5.6 |
| Strength (g/den) | 5.5 ± 1.2 | 2.7 ± 0.8 | 5.8–6.1 | 2.7–3.5 |
| Elongation (%) | 2.2 ± 0.7 | 6.8 ± 2.1 | 2–3 | 6–9 |
| Modulus (g/den) | 240 ± 74 | 70 ± 23 | 200–220 | 55–70 |
| Work of rupture (g/den) | 0.16 | 0.23 | 0.07–0.10 | 0.17–0.22 |
| Moisture regain (%) | 10.0 | 9.3 | 11–13 | 8–9 |

Advantageously, switchgrass fiber bundles may be treated to improve the performance and aesthetic properties of the fiber bundles. For example, softeners may be added to improve the smoothness and handle of the fiber bundles. Additionally, the fiber bundles or products comprising or made with switchgrass fiber bundles may be bleached, mercerized, dyed, cross-linked, treated with flame retardant, or a combination thereof according to a variety of known methods. Switchgrass fiber bundles may be processed according to any conventional and appropriate method to produce yarns that comprise switchgrass fiber bundles. These yarns may be used to make a variety of products. Moreover, switchgrass fiber bundles may be used as one hundred percent or blended with other fibers for textile and other applications. Examples of possible blends of switchgrass fiber bundles include cotton, wool, jute, cornhusk, cornstalk and rice straw fibers, linen, rayon, polyester, nylon and acrylic. Switchgrass fiber bundle products may be used in fields such as apparel, industrial, technical and medical.

c. Natural Cellulose Fiber Bundles from Sorghum

The fiber bundles may also be obtained from sorghum using the method of the present invention. For example, fiber bundles from sorghum leaf and stem having various properties as set forth in Table M have been produced. The sorghum leaf and stem fiber bundles having the properties set forth in Table M were coarser than cotton and linen but the length of the fiber bundles is suitable for processing for industrial applications such as textiles and fiber reinforced composites. The strengths of the sorghum stem and leaf fiber bundles were lower than that of cotton and linen but similar to that of cornhusk fiber bundles. The elongation of the sorghum fiber bundles was similar to that of linen but lower than that of cotton. The modulus of the sorghum fiber bundles was in between that of cotton and linen indicating that products made from such sorghum fiber bundles may be softer than linen fabrics. Both the sorghum stem and leaf fiber bundles had similar moisture regains that were higher than the regain of cotton but lower than that of linen.

TABLE M

Comparison of fiber bundle properties from *Sorghum*, Cotton and Flax.

| Fiber property | Leaf | Stem | Flax (Linen) | Cotton |
|---|---|---|---|---|
| Fineness (denier) | 65–90 | 59–95 | 5–18 | 3–5 |
| Length (cm) | 4.5–9.5 | 4–11.5 | 20–140 | 1.5–5.6 |
| Strength (g/den) | 2.35 ± 0.57 | 2.27 ± 0.49 | 5.8–6.1 | 2.7–3.5 |
| Elongation (%) | 2.59 ± 0.72 | 2.55 ± 0.64 | 2–3 | 6–9 |
| Modulus (g/den) | 114.5 ± 9.9 | 113.4 ± 10.3 | 200–220 | 55–70 |
| Moisture regain (%) | 9.8 | 9.5 | 11–13 | 7–8 |

The size, strength and elongation of fiber bundles obtained from sorghum stem and leaves are between those for cotton and flax. These properties indicate that the textiles made from the sorghum fiber bundles are likely to have performance properties between that of cotton and linen. It is expected that these sorghum fiber bundles will provide unique and desirable properties to textiles when blended with other fibers, especially synthetics. Since textile applications typically require fibers of the highest quality, the sorghum fiber bundles should also be suitable for other fibrous applications including composites.

d. Natural Cellulose Fiber Bundles from Rice Straw

In another embodiment of the present invention, fiber bundles are obtained from rice straw using the method of the present invention. Rice straw fiber bundles as shown in Table N may have a fineness between about 12 denier and about 27 denier.

Additionally, rice straw fiber bundles may be characterized based on their strength (tenacity). Rice straw fiber bundles as shown in Table N may have a strength of at least about 3.5 grams per denier to about 8 grams per denier (however, the fiber bundles may have a strength as low as about 1 gram per denier).

The rice straw fiber bundles may also be characterized based on their elongation percentage. Rice straw fiber bundles as shown in Table N may have an elongation of at least about 2.2% to about 3.5% (however, the fiber bundles may have an elongation as low as about 1% and as high as about 5%).

Still further, the rice straw fiber bundles may be characterized based on their moisture regain. Rice straw fiber bundles as shown in Table N may have a moisture regain of about 7.9% to about 9% at 65% relative humidity at 70° F.

Rice straw fiber bundle strength, elongation and modulus is intriguingly similar to flax. As summarized in Table N, the properties of the fiber bundles obtained from rice straw are compared with that of cotton, flax (linen), cornhusk, and cornstalk. The fineness, length, strength, elongation and modulus of the fiber bundles obtained from rice straw is suitable for processing as textile fibers. Rice straw fiber bundles have higher strength than cornhusk and cornstalk fiber bundles. The elongation of rice straw fibers is similar to cornstalk fiber bundles, but lower than cornhusk fiber bundles. Rice straw fiber bundles have a similar modulus to that of flax (linen), but a relatively high modulus compared to cornhusk and cornstalk fiber bundles. Rice straw fiber bundles have high work of rupture similar to flax (linen) fibers and cornstalk fiber bundles.

TABLE N

Comparison fiber bundle properties from Rice Straw, Cotton, Flax, Cornhusk, and Cornstalk.

| Fiber property | Rice | Flax (Linen) | Cotton | Cornhusk | Cornstalk |
|---|---|---|---|---|---|
| Fineness (denier) | 12–27 | 1.7–17.8 | 1.0–3.3 | 12.0–120 | 35–120 |
| Length (cm) | 2.5–8.0 | 20–140 | 1.5–5.5 | 2–20 | 1.5–8.5 |
| Strength (g/den) | 3.5–8.0 | 5.8 | 2.7 | 2.7 | 2.2 |
| Elongation (%) | 2.2–3.5 | 2–3 | 6.0–9.0 | 9.0–18.0 | 1.1–3.5 |
| Modulus (g/den) | 100–200 | 203 | 55 | 70 | 127 |
| Moisture regain (%) | 7.9–8.9 | 12 | 8.5 | 9.5 | 7.9 |

The size, strength and elongation of fiber bundles obtained from rice straw indicate that the textiles made from the rice straw fiber bundles will have the performance properties similar to cotton and linen, two of the best natural cellulose fibers. It is expected that these cornhusk fiber bundles will provide unique and desirable properties to textiles when blended with other fibers, especially synthetics. Since textile applications require fibers of the highest quality, the rice straw fiber bundles should also be suitable for other fibrous applications including composites.

e. Natural Cellulose Fiber Bundles from Wheat Straw

In another embodiment of the present invention, fiber bundles are obtained from wheat straw using the method of the present invention. For example, fiber bundles from wheat straw having various properties as set forth in Table O have been produced. As summarized in Table O, the properties of the fiber bundles obtained from wheat straw are compared with that of rice straw. The fineness, length, strength, elongation and modulus of the fiber bundles obtained from wheat straw is suitable for processing as textile fibers.

TABLE O

Tensile properties and moisture regain of wheat straw fibers compared with rice straw fibers. Errors are ± one standard deviations.

| | Wheat straw | Rice straw |
|---|---|---|
| Fiber properties | | |
| Denier | 35–100 | 13–31 |
| Length, cm | 4–8 | 2.5–8.0 |
| Strength, g/den | 2.1 ± 0.2 | 2.9–4.0 |

TABLE O-continued

Tensile properties and moisture regain of wheat straw fibers compared with rice straw fibers. Errors are ± one standard deviations.

| | Wheat straw | Rice straw |
|---|---|---|
| Elongation, % | 2.7 ± 0.1 | 1.9–2.5 |
| Modulus, g/den | 100 ± 11.7 | 174–227 |
| Moisture regain, % | 9.5 | 9.8 |

f. Natural Cellulose Fiber Bundles from Soybean Straw

In another embodiment of the present invention, fiber bundles are obtained from soybean straw using the method of the present invention. For example, fiber bundles from soybean straw having various properties as set forth in Table P have been produced. As summarized in Table P, the properties of the fiber bundles obtained from soybean straw are compared with that of rice straw. The fineness, length, strength, elongation and modulus of the fiber bundles obtained from wheat straw is suitable for processing as textile, composite and other high value industrial applications.

TABLE P

Soybean Straw Fiber Bundle Properties.

| | Soy Straw |
|---|---|
| Fiber properties | |
| Denier | 67 ± 32.6 |
| Length, cm | 8 ± 2.3 |
| Strength, g/den | 2.7 ± 1.4 |
| Elongation, % | 3.9 ± 1.4 |
| Modulus, g/den | 94 ± 38 |
| Moisture regain, % | 11.2 |

EXAMPLES a. Starting Materials i. Corn

Cornhusks were collected from fully mature plants in the greenhouses at the University of Nebraska-Lincoln and from cornfields in Nebraska. The collected cornhusks were cleaned by hand to remove the tassel, leaves, and other parts of the corn plant. Some cornhusks were treated un-cut whereas other cornhusks were cut into pieces having lengths between about 2 and about 3 cm using an INGENTO model A6T paper cutter. The cornhusk were cut so that the fibers obtained therefrom would have lengths similar to that of cotton to make them suitable for processing using a cotton spinning system.

Cornstalks were collected from ready-to-harvest corn fields in Nebraska, USA. Cornstalks were manually cleaned to separate the fibrous tissue from the pith tissue.

ii. Switchgrass

Switchgrass was collected from an experimental plot at the University of Nebraska-Lincoln. The outer leaves and the inner stems were manually separated from each other and used separately for fiber bundle extraction.

iii. Sorghum

Sorghum stover was collected from a research field at the University of Nebraska-Lincoln. The leaf and stem were manually separated from the stover. The outer leaves and stems were used separately for fiber bundle extraction.

iv. Rice Straw

Rice straw was obtained from commercial straw suppliers in California.

v. Wheat Straw

Wheat straw was obtained from a research field in Lincoln, Neb. The straw was used as is without any purification or pre-treatments or pre-washed in a 0.2% detergent solution in a launderometer at 70° C. for 30 minutes to remove the surface wax.

vii. Soybean Straw

Soybean straw was collected from an experimental research field in Lincoln, Nebr. after the seeds had been harvested. The straw was manually cleaned to remove leaves and other waste materials.

b. Testing Methods

The amount of pure cellulose in the corn fiber bundles was determined using the Norman and Jenkins method. Fiber bundle fineness (linear density) was calculated in terms of denier, defined as the weight in grams per 9000 m of the fiber, by weighing a known length of the fiber bundles.

The amount of pure cellulose in switchgrass and sorghum fiber bundles obtained from leaves and stems was determined using the Acid Detergent Fiber (ADF) method according to AOAC method (Helrich, 1999). Lignin in the fiber bundles was determined as Klason lignin according to ASTM standard method D 1106-96. Ash in the samples was determined by burning the fiber bundles at 550° C. for 16 hours.

Tensile properties of the fiber bundles were obtained using an Instron (Model 4000) fiber testing machine. A gauge length of 25 mm and crosshead speed of 18 mm $min^{-1}$ was used. Five sets of twenty fiber bundles each were tested to determine the denier and tensile properties. The average strength, elongation, modulus and work or rupture are reported along with the standard deviation between the sets of fiber bundles tested. All the fiber bundle property tests were conducted under the standard testing conditions of 21° C. and 65% relative humidity.

Moisture regain of the fiber bundles was determined using ASTM method D 2654. The test includes oven drying the fiber bundles at 105° C. for 4 hours and then allowing the sample to absorb water under the standard testing conditions for 24 hours. The percent regain was calculated as the ratio of the amount of water absorbed to the dry weight of the sample.

A Hitachi model S2000N SEM was used to investigate the morphological characteristics of individual cells and fiber bundles. For observation in the SEM, the individual cells and fiber bundles were laid down on an aluminum stub using a conductive adhesive tape and were sputter-coated with gold palladium prior to observations. Cross-sections of the samples were prepared according to standard methods. An Olympus AX70 fluorescence microscope with 40× lens was used to observe the cross-sections of untreated cornhusks and the extracted fiber bundles.

X-Ray diffraction was used to study the physical structure of the fiber bundle along with its constituents. X-ray diffraction patterns of corn fiber bundles were recorded from $2\Theta=0°$ to 30° using a Philips PW 1050/81 diffractometer. Specimens to be tested were powdered in a Wiley mill to pass a 2 mm mesh. The powder was mounted into a cavity holder to record the X-ray diffraction. The degree of crystallinity was calculated by integrating the area under the diffracted peaks after accounting for the amorphous and background scatter. Crystallite size was calculated using the Scherer's equation. X-ray diffraction pictures were obtained using a Bruker smart apex ccd camera. Averages of 8 readings were taken, each for 300 seconds at a sample to detector distance of 5.9 cm.

Two types of X-ray diffractometers were used to determine the physical structure of switchgrass and sorghum fibers bundles in terms of the percent crystallinity, crystal orientation in terms of crystallinity index ("CI") and also the multifibrillar angle ("MFA") in the fiber bundles. A Rigaku D-Max/B $\Theta/2\Theta$ X-ray diffractometer with Bragg-Brentano parafocusing geometry, a diffracted beam monochromator, and a copper target X-ray tube set to 40 kV and 30 mA was used to determine the percent crystallinity, crystal size and CI. These measurements were taken on fiber bundles made into pellets of about 5 mm thick. To make pellets, fiber bundles were powdered in Wiley mesh to pass through a 250 μm mesh and the powdered fiber bundles were pressed into a pellet using a hydraulic press operated at about 12,000 PSI. CI was determined from the intensity differences in the peak positions at 18° and 22° (Hindeleh, 1980). A Bruker D8 Discover model diffractometer equipped with an area detector and GAADS software was used to obtain the diffraction patterns and calculate the MFA. To obtain these measurements, a parallel bundle of fibers was mounted vertically in a specially designed sample holder with the axis of the fiber bundle perpendicular to the X-ray beam. The 002 peak intensities in the diffraction patterns were fit into two Gaussian curves using a non-linear least square algorithm with the software program Microcal ORIGIN to obtain the MFA.

c. Example 1

Alkali Treatments at Room Temperature i. Cornhusk

Partial decomposition of the cornhusk into thick strands was observed when cornhusk was allowed to remain in an aqueous alkali (NaOH) solution for about 24 hours in concentrations that were between about 0.1 and about 1.0 N at room temperature for a week. Only water soluble materials were removed whereas the lignin and hemicellulose were not affected by these treatments.

ii. Switchgrass

A. Leaf Material

About 200 grams of switchgrass leaf material were treated with an alkali solution containing sodium hydroxide at a concentration of about 0.75 N dissolved in water and allowed to remain in the solution for about 12 hours to about 14 hours at ambient conditions. The material was washed in warm water (45° C.) to remove dissolved substances. The switchgrass leaf material disintegrated into parts, but no fiber bundles were obtained.

B. Stem Material

About 200 grams of switchgrass stem material separated from the leaves were treated with an alkali solution containing sodium hydroxide at a concentration of about 1 N dissolved in water. Stem material was treated for 24 hours at room temperature under atmospheric pressure. Treated material was washed with water to remove dissolved substances. Treated material was neutralized in dilute acetic acid (10% w/w) solution. Treated material was rinsed in water following neutralization and dried under ambient conditions. The switchgrass stem material disintegrated into parts, but no fiber bundles formed.

iii. Sorghum

A. Leaf Material

Sorghum leaf material separated from the stem was treated with an alkali solution containing sodium hydroxide dissolved in water at a concentration of about 5% (w/w) using a liquor-to-material ratio of 10 to 1. Leaf material was treated with the alkali solution for about 12 to about 14 hours at ambient conditions. Treated material was washed with water to remove dissolved substances. The sorghum leaf material were disintegrated into parts, but no fiber bundles were obtained.

B. Stem Material

Sorghum stem material separated from leaves was treated with an alkali solution containing sodium hydroxide at a concentration of 8% dissolved in water. Stem material was treated for 24 hours at room temperature under atmospheric pressure. Treated material was washed with water to remove dissolved substances. Treated material was neutralized in dilute acetic acid (10% w/w) solution. Treated material was rinsed in water following neutralization and dried under ambient conditions. Sorghum stem material disintegrated into parts, but no fiber bundles formed.

d. Example 2

Extraction with Sodium Hydroxide at Elevated Temperatures i. Cornhusk

Cornhusk pieces were treated using sodium hydroxide solutions at different concentrations (between about 0.05 and about 1.0 N), for varying durations (between about 20 and about 90 minutes), and at varying temperatures (between about 60° C. and boiling) to obtain the fiber bundles. Extraction was carried out in atmospheric conditions using glass beakers. Temperature controllable hot plates were used to heat the solutions. Alkali at the required concentration was dissolved in water; the solution was heated to the required temperature before adding the cornhusk. After the treatment time, the treated husk was washed in tap water. A 20% acetic acid solution was used to neutralize any alkali remaining on the washed material. The fiber bundles were again rinsed in water and air-dried at ambient temperature.

It was found that changing the concentration, time, and temperature affected the fiber bundle quality (in terms of fineness of the fiber bundles) and also the yield of the fiber bundles. Generally, at lower concentrations and temperatures, and shorter durations, husk was partially disintegrated forming thick brownish yellow strands. While husk treated with boiling solutions tended to be completely dissolved after about 50 minutes, even at low alkali concentrations. It was determined that mixtures with solutions having a sodium hydroxide concentration that was between about 0.1 and 0.2 N maintained at the boiling point for about 45 minutes produced desirably fine fiber bundles at a yield that was between about 5 and about 8% based on the weight of cornhusk used. It should be noted that even at such solution concentrations cornhusk tended to completely hydrolyzed after 60 minutes at the boiling point. Without being bound to a particular theory, it was believed that this hydrolysis was due to the presence of oxygen.

ii. Cornstalks

Cornstalks were manually cleaned to separate the fibrous tissue from the pith tissue. Depithed cornstalks were treated with about 2% (w/v) sodium hydroxide solution for about 45 minutes at a temperature of about 95° C. using a liquor-to-stalk weight ratio of 20:1. The stalks and alkali solution were heated in a closed container on a temperature controlled hot plate. After the treatment, the fiber bundles were washed in warm water to remove the dissolved substances. The fiber bundles were neutralized using a solution of 10% (v/v) acetic acid. The neutralized fibers were dried under ambient conditions.

The yield of the fibers obtained depended, at least in part, on the fiber production conditions such as alkali concentration, time, temperature, and the stalk-to-liquor ratio used. It was observed that although the cornstalks contained about 40% cellulose, only about 15 to 20% by weight of the cornstalk starting material resulted in high quality fiber bundles.

iii. Switchgrass

A. Leaf Material at 95° C. for About 1 Hour

About 200 grams of switchgrass leaf material separated from the stem were treated with an alkali solution containing sodium hydroxide at a concentration of about 1 N dissolved in water. The alkali solution was brought to 95° C. on a temperature controlled hot plate and the leaf material was added. Leaf material was treated with the alkali solution for about 1 hour at atmospheric pressure. Fiber bundles were rinsed with warm water (45° C.) to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 36 denier with strength of about 6 grams per denier and elongation of 2.5%.

B. Leaf Material at 100° C. for 45 Minutes

About 200 grams of switchgrass leaf material separated from the stem were treated with an alkali solution containing sodium hydroxide at a concentration of about 0.5 N dissolved in water. The alkali solution was brought to 100° C. on a temperature controlled hot plate and the leaf material was added. Leaf material was treated with the alkali solution for about 45 minutes under atmospheric pressure. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles were course and not well separated. The fiber bundles had a fineness of about 200 deniers with a strength of 2 grams per denier and elongation of 2%.

C. Leaf Material at 100° C. for About 1 Hour

About 200 grams of switchgrass leaf material separated from the stem were treated with an alkali solution containing sodium hydroxide at a concentration of about 0.5 N dissolved in water. The alkali solution was brought to 100° C. on a temperature controlled hot plate and the leaf material was added. Leaf material was treated with the alkali solution for about 1 hour under atmospheric pressure. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles were course and not well separated. The fiber bundles had a fineness of about 30 deniers with a strength of 5.5 grams per denier and elongation of 2.2%.

D. Stem Material at 85° C. for About 45 Minutes

About 200 grams of switchgrass stem material separated from the leaves were treated with an alkali solution containing sodium hydroxide at a concentration of about 0.5 N dissolved in water. The alkali solution was brought to 85° C. on a temperature controlled hot plate and the stem material was added. Stem material was treated with the alkali solution for about 45 minutes at atmospheric pressure. Fiber bundles were rinsed with water to remove dissolved substances. Fiber bundles were neutralized in dilute acetic acid (10% w/w) solution. Fiber bundles were rinsed in water following neutralization and dried under ambient conditions.

The resulting fiber bundles had a fineness of about 80 deniers with a strength of about 2.8 grams per denier and elongation of 6.5%.

E. Stem Material at 100° C. for About 1 Hour

About 200 grams of switchgrass stem material separated from the leaves were treated with an alkali solution containing sodium hydroxide at a concentration of about 0.25 N dissolved in water. The alkali solution was brought to 100° C. on a temperature controlled hot plate and the stem material was added. Stem material was treated with the alkali solution for about 1 hour at atmospheric pressure. Fiber bundles were rinsed with water to remove dissolved substances. Fiber bundles were neutralized in dilute acetic acid (10% w/w) solution. Fiber bundles were rinsed in water following neutralization and dried under ambient conditions.

The resulting fiber bundles had a fineness of about 200 denier with a strength of about 2 grams per denier and elongation of 6%.

iv. Sorghum

A. Leaf Material at 95° C. with 1.5% Sodium Hydroxide

Sorghum leaf material separated from the stem was treated with an alkali solution containing sodium hydroxide at a concentration of about 1.5% (w/w) dissolved in water using a liquor-to-solid ratio of 10 to 1. The alkali solution was brought to 95° C. on a temperature controlled hot plate and the leaf material was added. Leaf material was treated with the alkali solution for about 30 minutes under atmospheric pressure. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 50 deniers, strength of about 2 grams per denier, and elongation of about 2%.

B. Leaf Material at 95° C. with 2% Sodium Hydroxide

Sorghum leaf material was treated with an alkali solution containing sodium hydroxide dissolved in water at a concentration of about 2% (w/w) using a liquor-to-material ratio of 10 to 1. The alkali solution was brought to 95° C. on a temperature controlled hot plate and the leaf material was added. Leaf material was treated with the alkali solution for about 30 minutes. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 65 to about 105 denier. Length of the fiber bundles was between about 4 cm to about 10 cm. Strength of the fiber bundles was between about 1.5 grams per denier and about 3 grams per denier. Elongation of leaf fiber bundles was between about 1.5% to about 3.5%. The modulus of leaf fiber bundles was between about 100 grams per denier and about 125 grams per denier. The moisture regain of leaf fiber bundles was about 10%.

C. Leaf Material at 95° C. with 3% Sodium Hydroxide

About 500 grams of sorghum leaf material separated from the stem were treated with an alkali solution containing sodium hydroxide at a concentration of about 3% (w/w) dissolved in water using a liquor-to-solid ratio of 10 to 1. The alkali solution was brought to 95° C. on a temperature controlled hot plate and the leaf material was added. Leaf material was treated with the alkali solution for about 30 minutes under atmospheric pressure. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles were course and not well separated. The fiber bundles had a fineness of about 200 deniers with a strength of about 2 grams per denier and elongation of about 2%.

D. Stem Material at 85° C. with 0.05 N Sodium Hydroxide

Sorghum stem material separated from leaves was treated with an alkali solution containing sodium hydroxide at a concentration of about 0.05 N dissolved in water. The alkali solution was brought to 85° C. on a temperature controlled hot plate and the stem material was added. Stem material was treated with the alkali solution for about 45 minutes. The material was washed in water to remove dissolved substances. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 100 deniers with a strength of about 2.2 grams per denier and an elongation of about 2%.

E. Stem Material at 95° C. with 0.05 N Sodium Hydroxide

Sorghum stem material separated from leaves was treated with an alkali solution containing sodium hydroxide at a concentration of about 0.05 N dissolved in water. The alkali solution was brought to 95° C. on a temperature controlled hot plate and the stem material was added. Stem material was treated with the alkali solution for about 30 minutes. The material was washed in water to remove dissolved substances. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 150 deniers with a strength of about 2.5 grams per denier and an elongation of about 2%.

F. Stem Material at 95° C. with 4% Sodium Hydroxide

Sorghum stem material separated from leaves was treated with an alkali solution containing sodium hydroxide dissolved in water at a concentration of about 4% (w/w) using a liquor-to-solid ratio of 15 to 1. The alkali solution was brought to 95° C. on a temperature controlled hot plate and the stem material was added. Stem material was treated with the alkali solution for about 45 minutes. The material was washed in water to remove dissolved substances. Fiber bundles were washed with water to remove dissolved substances. Fiber bundles were neutralized in dilute acetic acid (10% w/w) solution. Fiber bundles were rinsed in water following neutralization and dried under ambient conditions. The extracted fiber bundles were tested for their mechanical properties.

The resulting fiber bundles had a fineness of about 30 to about 95 denier. Length of the fiber bundles was between about 4 cm to about 12 cm. Strength of the fiber bundles was between about 1.5 grams per denier and about 3 grams per denier. Elongation of stem fiber bundles was between about 1.5% to about 3.5%. The modulus of stem fiber bundles was between about 100 grams per denier and about 125 grams per denier. The moisture regain of stem fiber bundles was about 10%.

v. Rice Straw

Rice straw was treated with a sodium hydroxide at a concentration of 1 N for 40 minutes at 100° C. with 5% (w/w) liquor-to-solid ratio. The treated fiber bundles were washed in water to remove the dissolved substances and the fibers formed were dried under ambient conditions. About 10% of the initial weight of rice straw used was obtained as high quality rice fibers after the alkali treatments.

vi. Wheat Straw

Wheat straw was treated in a 0.2% detergent solution in a launderometer at 70° C. for 30 minutes to remove the surface wax. Fiber bundles were extracted from pretreated straw using 2% sodium hydroxide solution at 95° C. for 45 minutes with a liquid-to-solid ratio of 15 to 1. The treated straw was thoroughly washed in water to remove the dissolved substances. The resulting fiber bundles were neutralized using 3% (w/w) acetic acid solution, washed with water, and air dried.

The resulting fiber bundles had a fineness of about 30 to about 100 denier. Length of the fiber bundles was between about 4 cm to about 8 cm. Strength of the fiber bundles was between about 1.9 grams per denier and about 2.3 grams per denier. Elongation of fiber bundles was between about 2.6% to about 2.8%. The modulus of fiber bundles was between about 88 grams per denier and about 112 grams per denier. The moisture regain of fiber bundles was about 9.5%. Under these conditions, about 25% of the fiber bundles obtained have the desired properties. Although it is possible to obtain higher yields of fiber bundles, the fiber bundles may be coarser.

vii. Soybean Straw

The outer layer of the soybean straw was boiled in a 8% sodium hydroxide solution for 2 hours with about 10% of the material in the alkali solution. The treated material was then washed thoroughly to remove the dissolved substances. Fibers formed were neutralized using dilute acetic acid (10% w/w) to remove any alkali remaining on the fibers. The washed and neutralized fibers were dried under ambient conditions. The soybean straw fibers have deniers in the range of about 30 to about 90.

e. Example 3

Reducing Agent i. Cornhusk

According to the conditions in Example 2, a reducing agent (sodium hydrosulfite) was added in an attempt to prevent oxidation of the fiber bundles. The addition of sodium hydrosulfite in the alkali solution at concentrations between about 1 and about 10% on weight of the cornhusks was tested. No effect was observed on improving the quality or yield of fibers.

f. Example 4

Delignifying Agent i. Switchgrass

A. Stem Material

About 200 grams of switchgrass stem material separated from the leaves were treated with an alkali solution containing sodium hydroxide at a concentration of about 0.5 N dissolved in water. A reducing agent, sodium sulfite at a concentration of 1% (w/v) was added as a component of the alkali solution to aid in removal of lignin from the fiber bundles. The alkali solution was brought to 85° C. on a temperature controlled hot plate and the stem material was added. Stem material was treated with the alkali solution for about 45 minutes at atmospheric pressure. Fiber bundles were rinsed with water to remove dissolved substances. Fiber bundles were neutralized in dilute acetic acid (10% w/w) solution. Fiber bundles were rinsed in water following neutralization and dried under ambient conditions.

The resulting fiber bundles decreased in fineness from about 80 to about 63 denier. No change in fiber bundle strength or elongation was observed.

B. Inner Stem Material

Switchgrass inner stem material separated from the leaves was treated with an alkali solution containing sodium hydroxide at a concentration of about 1 N dissolved in water. The alkali solution was brought to 100° C. on a temperature controlled hot plate and the inner stem material was added. Inner stem material was treated with the alkali solution for about 1 hour at atmospheric pressure. Sodium sulfite at a concentration of about 1% (w/v) was included in the alkali solution to aid in removal of lignin from the fiber bundles. The alkali-treated material was washed with warm water (45° C.) to remove dissolved substances. The resulting crude fiber bundles were retreated with an alkali solution containing sodium hydroxide at a concentration of about 0.5 N. The alkali solution was brought to 95° C. on a temperature controlled hot plate and the stem material was added. The crude fiber bundles were treated with the alkali solution for about 30 minutes under atmospheric pressure. Fiber bundles were neutralized in dilute acetic acid (10% w/w) solution. Fiber bundles were rinsed in water following neutralization and dried under ambient conditions.

The resulting fiber bundles had a fineness of about 60 deniers with a strength of about 2.7 grams per denier and elongation of 6.8%.

ii. Sorghum

Sorghum stem material separated from the leaves were treated with an alkali solution containing sodium hydroxide at a concentration of about 0.5 N dissolved in water. Sodium sulfite at a concentration of 1% (based on the weight of the stem material) was added as a component of the alkali solution to aid in removal of lignin from the fiber bundles. The alkali solution was brought to 85° C. on a temperature controlled hot plate and the stem material was added. Stem material was treated with the alkali solution for about 45 minutes at atmospheric pressure. Fiber bundles were rinsed with water to remove dissolved substances. Fiber bundles were neutralized in dilute acetic acid (10% w/w) solution. Fiber bundles were rinsed in water following neutralization and dried under ambient conditions.

The resulting fiber bundles decreased in fineness from about 100 to about 70 denier. No change in fiber bundle strength or elongation was observed.

g. Example 5

Controlling the Concentration of Available Oxygen i. Cornhusk

To minimize the amount of oxygen available during extraction, experiments were conducted in closed containers using hot-air ovens to control the temperature. Alkali concentrations from between about 0.2 N and about 0.7 N at temperatures between about 60° C. and about 100° C. were used. The treatment time was between 20 and about 90 minutes depending on the concentration and temperature. The experimental conditions used during the controlled oxygen trials are set forth in Table Q. After the treatment, the fiber bundles were washed in water, neutralized in acid and rinsed in water and allowed to air-dry at room temperature. The fiber bundle qualities and fiber bundle yield were similar to those obtained in Example 2.i. for each particular combination of concentration, time, and temperature.

TABLE Q

Conditions for controlled oxygen trials.

| Alkali Concentration (N) | Temperature (° C.) | Time (minutes) |
|---|---|---|
| 0.2 | 100 | 40 |
| 0.2 | 100 | 60 |
| 0.2 | 100 | 90 |
| 0.3 | 100 | 30 |
| 0.3 | 80 | 40 |
| 0.3 | 80 | 60 |
| 0.5 | 100 | 20 |
| 0.5 | 70 | 40 |
| 0.5 | 70 | 60 |
| 0.7 | 100 | 20 |
| 0.7 | 60 | 40 |
| 0.7 | 60 | 60 |

h. Example 6

Alkali Treatment at Higher Concentrations and Temperature i. Cornhusk

For industrial application and mass production, it most likely would be desirable to use higher concentration of alkali and temperature and reducing the treatment time to the minimum. As such further tests similar to those set forth in Examples 1 and 2 were performed and it was found that fiber bundles of acceptable quality were produced at a yield of about 8% using an alkali concentration between about 0.3 and about 0.7 N at a temperature in the range of about 80° C. to about 95° C. for a duration between about 20 and about 70 minutes.

i. Example 7

Ratio of Liquor to Cornhusk

To reduce the cost, consumption of chemicals, and waste, further testing was performed to in an attempt to determine an optimum range for the ratio of liquor (alkali solution) to cornhusk. Trials were done varying the liquor to husk ratio (by weight) from about 30:1 to about 8:1 according to the conditions as in Examples 1 and 2. It was determined that acceptable fiber bundles were consistently extracted at a rate of about 8% at liquor-to-husk ratios no greater than about 15:1.

i. Example 8

Treatment with Cellulase i. Cornhusk

Fiber bundles that had already been extracted by exposure to an alkali solution were treated with cellulase-containing solutions of varying concentration to study what effect, if any, such treatments would have on reducing the diameter, or increasing the fineness of the fiber bundles. Aqueous cellulase solutions having a cellulase concentration that was between about 2% and about 10% by weight of the fiber bundles were tested at about 60° C. for about 60 minutes. The tested fiber bundles were dissolved within ten minutes of the treatment, even at the low concentration of about 2%. This indicated that cellulase is an effect agent for the improvement of fiber bundle fineness and that the concentration of cellulase in an enzyme solution is preferably less than about 2%, and that a preferable treatment duration is, most likely, less than about 10 minutes.

Further testing to date, however, determined that an enzyme treatment involving a cellulase-containing solution preferably comprises the following parameters: a cellulase concentration that is between about 0.5 and about 1.5%, a temperature that is between about 45 and about 60° C., a pH that is between about 4 and about 7, for a duration that is between about 5 and about 30 minutes. An enzyme treatment performed according to these parameters may be used to decrease fiber bundle denier between about 10 and about 50%.

k. Example 9

Treatment with Sodium Carbonate i. Cornhusk

Sodium carbonate is a weaker alkali compared to sodium hydroxide. Solutions comprising sodium carbonate were tested in which the concentrations of sodium carbonate were between about 1 N and about 2 N. The solutions were maintained at the boiling point and the cornhusks were treated for durations that were between about 40 and about 90 minutes. After the alkali treatment the fibers were washed with water, then neutralized with a 10% acetic acid solution, rinsed with water again, and then air-dried at ambient temperature. The extracted fiber bundles were coarse, specifically larger than 70 denier, and brownish yellow in color. Compared to the tested sodium hydroxide solutions, the sodium carbonate solutions tended to have higher fiber yields. Specifically, the sodium carbonate solutions tested under these conditions had fiber yields between about 10 and about 12%.

ii. Rice Straw

Rice straw was treated with a 2 N concentration of sodium carbonate solution at 100° C. for 90 minutes to extract rice straw fiber bundles. The rice straw fiber bundles were washed in water and neutralized using dilute acetic acid (10% w/w) solution. The rice straw fiber bundles were rinsed in water and air-dried at ambient temperature. Rice straw fiber bundles were coarse and brownish yellow in color. Higher rice straw fiber bundle yield of about 10 to 12% was obtained under these conditions. However, fiber bundle quality measured by length, strength and other quality factors was reduced as compared to fiber bundle quality obtained using sodium hydroxide and enzyme treatments.

l. Example 10

Alkali and Enzyme Treatments i. Cornhusk

Uncut cornhusks were treated with a solution of about 2% sodium hydroxide for about 2 hours at about 80° C. using a liquor-to-solid ratio of about 20:1. The treated fiber bundles were washed in warm tap water to remove the dissolved substances, and the fiber bundles were dried under ambient conditions. The alkali extracted fiber bundles were treated with an about 5% PULPZYME and cellulase solution at about 50° C. for about 30 minutes using a material to liquor-to-husk ratio of about 20:1 and maintaining the pH of the enzyme solution between about 5 and about 5.5. The enzyme treated fiber bundles were thoroughly rinsed in water and dried under ambient conditions.

The tested fiber bundles had a crystallinity of about 50% as summarized in Table R, which is a comparison of fiber bundle structures, and as indicated by the X-ray diffraction peaks. Although the percent crystallinity of corn fiber bundles is lower than that of the commonly used natural cellulose fibers, fiber bundles obtained from agricultural byproducts such as pineapple and banana leaves have similar crystallinities of about 50%. The presence of higher amounts of noncellulosic substances is a major reason for the lower crystallinity of fibers obtained from lignocellulosic agricultural byproducts.

The lower crystallinity of corn fiber bundles relative to the more common natural cellulose fibers such as cotton, linen, and jute provide unique characteristics to the corn fiber bundles. For example, the lower crystallinity corresponds to a larger amount of amorphous regions, which tends to make corn fiber bundles be more accessible to water and other chemicals (i.e., relatively higher moisture regain and chemical absorptions).

tively higher number of individual cells are held together by the binding substances such as lignin and hemicellulose. Without being bound to a particular theory, it is believed that the higher number of individual cells and higher amount of binding materials in the fiber bundle not only make it coarser, but also decrease the tensile strength of the fiber bundle. More specifically it is believed that the higher number of individual cells and presence of encrusting substances increase the number of weak spots in the fiber bundle consequently decreasing the fiber bundle strength. Regardless, the tensile strength of the long staple corn fiber bundles test was similar to that of wool, but less than that of other natural cellulosic fibers (see Table S).

The tested corn fiber bundles, however, tended to have a substantially higher percentage of elongation than other natural cellulosic fibers (see Table S). Without being bound to a particular theory, it is believed that the higher elongation of corn fiber bundles is due primarily to their relatively poor orientation and lower degree of crystallinity. The spiral angle, which is the arrangement of the cellulose fibrils to the fiber axis, is also believed to play a significant role in determining the extensibility of multicellular fiber bundles. Generally, the extensibility of fiber bundles increases with increasing spiral angle. This is why coir, which has a spiral angle of about 45 degrees, has a very high extensibility of about 30%.

TABLE R

Comparison of Fiber Bundle Structure

| | Corn | Wool | Cotton | Linen | Jute | Ramie | Kenaf | Hemp | PALF* | Sisal |
|---|---|---|---|---|---|---|---|---|---|---|
| Single cell | | | | | | | | | | |
| Length (mm) | 0.5–1.5 | — | 15–56 | 4–77 | 0.8–6.0 | 40–250 | 1.5–11 | 5.0–55 | 3–9 | 0.8–8 |
| Width (μm) | 10–20 | — | 12–25 | 5–76 | 15–25 | 16–126 | 12–36 | 10–51 | 20–80 | 7–47 |
| Fiber length (cm) | 6–23 | 5–50 | 1.5–5.5 | 20–140 | 150–360 | 40–150 | 150–180 | 100–300 | 55–75 | 40–100 |
| Fiber denier | 80–140 | — | 1.0–3.3 | 1.7–17.8 | 13–27 | 4.6–6.4 | 50 | 3.9–24.4 | 20–34 | 9–406 |
| % cellulose content | 80–87 | — | 88–95 | 72–82 | 62–64 | 69–83 | 66 | 67–75 | 70–82 | 67–78 |
| % crystallinity | 48–50 | 35–30 | 65–75 | 65–70 | 65–70 | 70–74 | 61–69 | 81–89 | 44–60 | 68–78 |

*Pineapple leaf fibers

TABLE S

Comparison of Fiber Bundle Properties

| Fiber property | Corn | Wool | Linen | Jute | Ramie | Kenaf | Hemp | Pineapple | Sisal |
|---|---|---|---|---|---|---|---|---|---|
| Tenacity (g/den) | 1.4–1.6 | 1.2–1.6 | 5.8–6.1 | 3.2–3.5 | 6.4–7.3 | 1.0–2.3 | 5.2–6.8 | 0.7–3.8 | 4.1–5.3 |
| Percent Elongation | 13–16 | 29–43 | 2.0–3.0 | 0.9–1.2 | 2.3–4.6 | 1.3–5.5 | 1.7–2.6 | 0.8–1.6 | 3.0–7.0 |
| Modulus (g/den) | 36.0 | 24–34 | 203.0 | 195.0 | 161–300 | 92 | 203–245 | — | 285 |
| Work of rupture (gm · cm/den) | 0.23 | 0.36 | 0.09 | 0.03 | 0.12 | 0.09 | 0.06 | — | — |
| Percent Moisture Regain | 8.5–9.5 | 14–19 | 12.0 | 13.8 | 8.5 | 17 | 12 | 10–13 | 1.9–4.5 |

As summarized in Table S, fiber bundles with lengths suitable for processing on the long staple machinery and for blending with most long staple fibers including wool can be extracted from cornhusks. Depending on the treatment conditions, fiber bundles equivalent to the length of the cornhusk (about 20 to about 25 cm) can be extracted. Cornhusks can also be cut into any required length to obtain fiber bundles suitable for processing on the short staple machinery. The long staple corn fiber bundles had finenesses between 80 and about 140 denier and tended to be relatively coarser than the short staple corn fiber bundles. In long fiber bundles, a rela- The relatively high elongation percentage of the corn fiber bundles gives them unique properties in terms of the modulus and work of rupture. Specifically, the modulus of the corn fiber bundles was determined to be similar to that of wool, but lower than that of the other natural fibers listed in Table S. The lower modulus provides corn fiber bundles a softer hand and, therefore, products made from them are expected to be comfortable to wear. Since corn fiber bundles have the highest work of rupture among the natural cellulose fibers reported in Table S, corn fiber bundles are also expected to be highly durable. The relatively high extensibility, low modulus, and high durability provides corn fiber bundles unique properties that may be especially useful for blending with relatively inextensible fibers such as linen and jute. Also, the moisture absorption of corn fiber bundles is similar to that of cotton and ramie. The combination of the foregoing properties, among other things, make corn fiber bundles a unique fiber for producing textiles and easily processed on conventional textile machinery.

ii. Switchgrass Leaf Material

Fiber bundles obtained according to Example 2.ii. above were treated with an enzyme solution containing both cellulase and PULPZYME at concentrations of about 5% (w/w). The enzyme solution was brought to 50° C. and fiber bundles were added.

The fiber bundles in enzyme solution were treated at 50° C. on temperature controlled hot plates for about 45 minutes at atmospheric conditions. The enzyme solution was maintained at a pH of 5.5.

The resulting fiber bundles had a fineness of about 130 deniers with no appreciable improvement observed in the strength and elongation as compared to fiber bundles according to Example 2.ii. above.

iii. Sorghum Leaf Material

About 500 grams of sorghum leaf material separated from the stem were treated with an alkali solution containing sodium hydroxide at a concentration of about 3% dissolved in water. The alkali solution was brought to 95° C. on a temperature controlled hot plate and the leaf material was added. Leaf material was treated with the alkali solution for about 30 minutes under atmospheric pressure. Fiber bundles were washed with water to remove dissolved substances. Fiber bundles were neutralized in dilute acetic acid (10% w/w) solution. Fiber bundles were rinsed in water following neutralization and dried under ambient conditions. Following alkali treatment, fiber bundles were treated with an enzyme solution containing the enzymes cellulase and PULPZYME. The enzyme solution was brought to 55° C. and fiber bundles were added. The fiber bundles in enzyme solution were treated at 55° C. on temperature controlled hot plates for about 30 minutes at atmospheric conditions. The enzyme solution was maintained at a pH of 5.5.

Although the fineness of the fiber bundles decreased from about 200 deniers to about 60 deniers, no appreciable improvement in the strength or elongation was observed.

iv. Rice Straw

Rice straw fiber bundles obtained from the alkali treatments were treated with 1% (on weight of the fiber) each of PULPZYME and cellulase. The enzyme treatment was carried out at 55° C. for 40 minutes with 5% of the fiber bundles in the enzyme solution at a pH of 6.0. Rice straw fiber bundles obtained after the enzyme treatment were washed in water and dried under ambient conditions. The properties of the high quality rice fibers obtained after the alkali and enzyme extraction are described in detail below.

m. Example 11 i. Cornhusk

Fiber bundles were obtained from cornhusks by a combined chemical and enzymatic extraction. Cornhusks were treated with 0.5 N sodium hydroxide solution for 60 minutes at 95° C. with 5% of cornhusks by weight in the alkali solution. The treated slurry was washed in water to remove the dissolved substances and the coarse fiber bundles obtained were neutralized using dilute acetic acid (10% w/w) solution. The neutralized fiber bundles were dried under ambient conditions. The fiber bundles were then subjected to an enzyme treatment with a solution comprising PULPZYME and cellulase. An enzyme concentration of 5% with about 5% (w/v) of fiber bundles in the enzyme solution, and a treatment time of 60 minutes at 50° C. were used. Fiber bundles obtained after the enzyme treatment were washed in water and dried under ambient conditions. The fiber bundles yields ranged from 15-20% with fiber bundle fineness between 12-120 denier.

Natural cellulosic fibers contain anywhere between 60-95% cellulose. Hemicellulose, lignin, pectin, waxes and proteins are the remaining constituents, their proportion depending on the conditions of growth, fiber bundle source, and method of fiber bundle extraction. Table T shows that corn fiber bundles contain about 80-87% cellulose, a relatively higher quantity when compared to linen and jute. Most of the hemicellulose is removed during fiber bundle extraction and the remaining hemicellulose, lignin and pectin hold the individual cells in the form of a fiber bundle.

TABLE T

Physical characteristics of Corn fiber bundles to other fiber sources.

| | | | | Single cell dimensions | |
|---|---|---|---|---|---|
| Fiber/bundle | Cellulose (%) | Color | Fiber length (cm) | Length (mm) | Width (μm) |
| Corn | 80–87 | Yellowish white | 2–20 | 0.5–1.5 | 10.0–20.0 |
| Cotton | 88–95 | Off white | 1.5–5.5 | 15.0–56.0 | 12.0–25.0 |
| Linen | 72–82 | Creamy white | 20–140 | 4.0–77.0 | 5.0–76.0 |
| Jute | 62–64 | Brownish | 150–360 | .8–6.0 | 15.0–25.0 |

The physical structure of a fiber bundle describes the amount of crystalline (ordered) and amorphous (disordered) material, their orientation to the fiber axis and the size of the crystals present in a fiber bundle. All celluloses, such as cotton, ramie and wood, have the same polymer and similar crystal structures, but the fibers have greatly different properties. The differences are due to the differences in the orientation of the crystalline and amorphous regions with respect to the fiber axis, in the size and perfection of the crystalline regions, in the relative amounts of crystalline and amorphous materials, and in amounts and type of non-cellulosic material. Corn fiber bundles vary considerably in these parameters relative to the other most common natural fibers as seen from Table U. In comparison to commercially available cotton, linen, and jute fibers, corn fiber bundles have a lower percentage of crystallinity, lower orientation with respect to the fiber's axis, and smaller crystal size than cotton.

TABLE U

Comparison of corn fiber bundle crystallinity with other fiber sources.

| Fiber | Crystallinity (%) | Crystal size (nm) |
|---|---|---|
| Corn | 48–50 | 3.2 |
| Cotton | 65–75 | 5.5 |
| Linen | 65–70 | 2.8 |
| Jute | 65–70 | 2.8 |

Lower percent crystallinity means, of course, less strength, but also increased elongation, higher moisture regain and more available sites for chemical reactions. The amorphous regions are the regions responsible for the increased elongation, because when the fiber is stretched, molecules in these regions can align themselves to become more oriented to the fiber axes without rupture. Molecules in crystalline regions cannot move easily, and fibers with large percent crystallinity tend to be brittle. Amorphous regions with lots of void space between molecules are also easily accessible to water and chemicals. Therefore corn fiber bundles have higher moisture regain than cotton and would have more easily accessible sites for reactions with dyes and other chemicals as well as greater pliability and elongation.

In addition to crystallinity, the size of crystals also influences the ability of a fiber to absorb water (moisture regain) or other chemicals. Smaller crystal size means more surface area of the fiber and therefore higher accessibility to water and other chemicals. Smaller crystals decrease the distance between layers of cellulose, increasing the capillary effect that brings higher moisture and other absorptions.

Fiber bundle strength, however, is partly determined by the orientation of the crystalline regions to the fiber axis. The orientation of the crystals in the fiber bundle is determined from their X-ray diffraction patterns, commonly called fiber diagrams. The fiber diagram of corn fiber bundle shows diffraction arcs much longer and broader than those in cotton, indicating poor orientation of the crystals to the fiber axis. In addition, the broadening of the arcs in corn fiber bundles along the radius of the pattern is characteristic of crystallites that are either very smaller very imperfect. The lower degree of the orientation means fiber bundles that exhibit less strength, because the stress placed upon the fiber bundles may not be in the direction of the strong crystalline regions.

The lower degree of crystallinity and crystal orientation (conversely the higher amount of amorphous regions) of cellulose in cornhusk is what gives corn fiber bundles lower strength than the three most popular cellulosic fibers, but corn fiber bundles have increased elongation, higher moisture regain, and more accessible sites for dyes and other chemicals.

The fiber bundles properties, like strength, elongation, modulus, and moisture regain, are measurable properties that are used to help compare one fiber's performance with another. Fiber bundle properties are determined by fiber bundle structure, but fiber bundle properties provide more meaningful physical comparisons between fiber bundles than do fiber bundle structure comparisons. Often, fiber bundle properties are unique, and that uniqueness is used in combination with other fibers to create materials with the best properties for a particular application.

Figure 2:
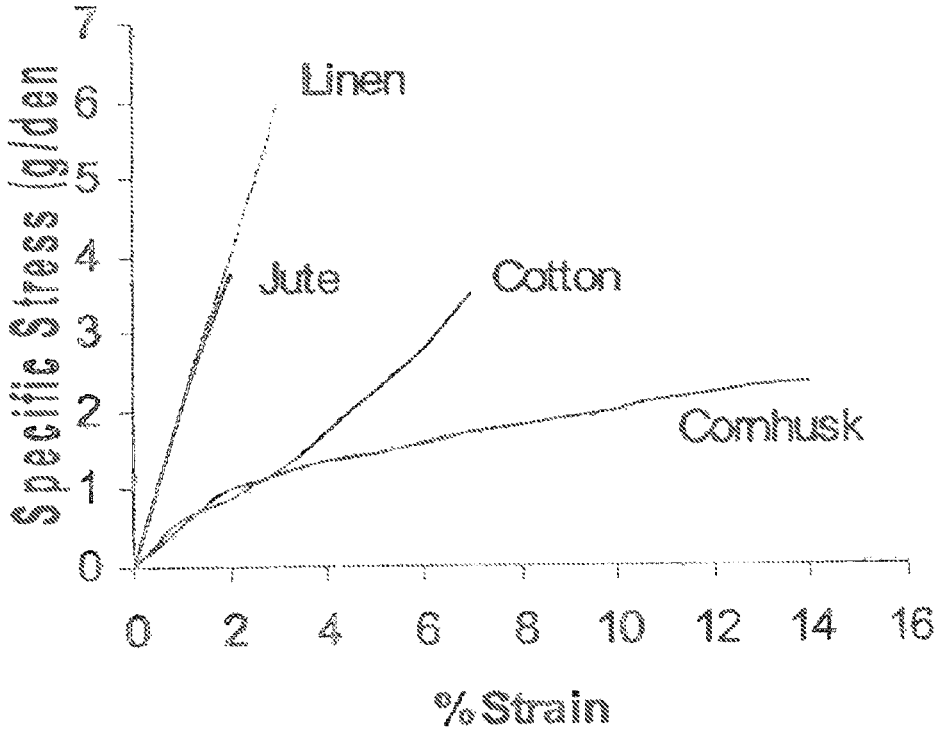
FIG. 2 is graph of stress versus strain comparing fiber bundles of the present invention (i.e., cornhusk fiber bundles) to other types of natural cellulosic fibers.

Tensile tests measure the behavior of fibers when a force of deformation is applied along the fiber axis in terms of tenacity, percent elongation, initial modulus and work of rupture. Tenacity is defined as the specific stress corresponding with the maximum force on a force-extension curve and indicates the load that a fiber can bear before it breaks. Generally, natural fibers have a characteristic higher tenacity and lower elongation or vice-versa. The tensile behavior of the fibers in terms of the modulus and work of rupture are obtained from the stress-strain curves shown in FIG. 2, the curves for cotton, linen and jute are from the data in literature. Modulus of a fiber measures the slope of the force elongation curve and is a measure of the stiffness of the material, that is its resistance to extension. The higher modulus of a material, and less it extends for a given force. Cotton has a lower modulus than linen and jute and is therefore more flexible and soft. Work of rupture is a measure of the toughness of the material and is the total energy required to break the material and depends on both the tenacity and elongation of a fiber. Higher work of rupture means a more durable fabric even though the fiber has low strength. For example, although wool has lower tenacity than cotton, it is more durable due to its high elongation and therefore higher work of rupture. Jute has low work of rupture and hence is less durable than linen and cotton.

Corn fiber bundles have the unique advantage of moderate strength but with higher toughness, low modulus and higher elongation as reported in Table V. These properties make it highly durable but pliable and soft, a property desired for apparel and similar applications. The work of rupture for corn fiber bundles is higher than cotton, however, so that though weaker, corn fiber bundles is tougher or more durable to wear. Therefore, with the unique and exceptional blend of moderate strength, high elongation, great pliability and toughness, corn fiber bundles are ideal for all practical applications utilizing natural fibers.

TABLE V

Comparison of corn fiber bundles properties with other fiber sources.

| Fiber | Tenacity (g/denier) | Elongation (%) | Modulus (g/denier) | Work of rupture (g/denier) | Moisture regain (%) |
|---|---|---|---|---|---|
| Corn | 2.7 ± 0.11 | 15.3 ± 2.15 | 70 ± 1.65 | 0.23 ± 0.05 | 9.5 |
| Cotton | 2.7–3.5 | 6.0–9.0 | 55 | 0.19 | 8.5 |
| Linen | 5.8–6.1 | 2.0–3.0 | 203 | 0.09 | 12.0 |
| Jute | 3.2–3.5 | 0.9–1.2 | 195 | 0.03 | 13.8 |

The higher moisture regain of corn fiber bundles in comparison to cotton is due to the lower crystallinity and crystal size of cellulose in corn fibers. As predicted by chemical and physical structure, the higher amount of accessible regions, surface area and capillary effect contribute to the higher regain of corn fiber bundles. Although linen and jute fibers have higher crystallinity than corn fiber bundles, their relatively higher moisture regain is due to the presence of non-cellulosic substances, especially hemicellulose and pectin, which are hydrophilic. The high moisture regain of corn fiber bundles suggests that apparel made from corn fiber bundles would be comfortable to wear. The unique corn fiber bundles properties compare favorably with those of other common natural cellulosic fibers which make them suitable for use in all fibrous applications.

n. Example 12

Fiber Bundles Processing i. Cornhusk Fiber Bundle Blends

Fiber bundles from cornhusk were blended with cotton and polyester and processed on ring and rotor spinning machines. The 50 gram spinning test was used to evaluate the spinnability of the fiber bundles (Landstreet et al., Textile Research Journal, August 1992, 665-669). Cornhusk fiber bundles were blended with cotton in the ration of 35:65 (corn:cotton) and processed on the open end spinning machine to product 30 and 84 tex yarns. Cornhusk fiber bundles were also blended with cotton in the ratio of 50:50, 30:70, and 20:80 and processed on a ring frame to make 30, 38, and 50 tex yarns for each blend. Additionally, cornhusk fiber bundles were blended with polyester fibers at a ratio of 35:65 (corn:polyester) and processed on the ring frame to produce a 23 tex yarn. Control yarns of the same sizes were made form 100% cotton and a 35:65 cotton:polyester blend. The strength and elongation of the corn blended yarns were comparable to the control yarns. The cornhusk fiber bundle-containing yarns were suitable for apparel and other textile applications. Some specific results of the yarn processing trials are set forth in Tables W-Y.

TABLE W

Properties of cotton/corn fiber bundle blends.

| | Strength | | Elongation | |
|---|---|---|---|---|
| Fiber Blend | g/tex | % Retention | % | % Retention |
| 30 Cotton/corn (50:50) | 8.9 | 81 | 4.2 | 136 |
| 84 OE Cotton/Corn (65:35) | 8.7 | 64 | 6.9 | 83 |
| 27 Poly/Corn (65:35) | 17.6 | 117 | 15.7 | 104 |

TABLE X

Properties of cotton/corn fiber bundle blends to cotton/pineapple and cotton/kenaf blends.

| Fineness | Strength | | | Elongation | |
|---|---|---|---|---|---|
| 50 tex (80:20) | g/tex | CV % | % Retention | % | % Retention |
| Cotton/Pineapple | 17.6 | 24 | 117 | 15.7 | 104 |
| Cotton/Kenaf | 15.0 | 24 | 88 | 6.2 | 85 |
| Cotton/Corn | 12.6 | 26 | 87 | 6.6 | 92 |

TABLE Y

Properties of cotton/corn fiber bundle blends to cotton/milkweed blends.

| Fineness | Strength | | | Elongation | |
|---|---|---|---|---|---|
| 30 tex (50:50) | g/tex | CV % | % Retention | % | % Retention |
| Cotton/Milkweed | 8.2 | 16 | 80 | 6.4 | 91 |
| Cotton/Corn | 8.9 | 19 | 81 | 4.2 | 136 |

The yarns made from the 35% corn and 65% cotton blend were knitted into a garment. The garment was dyed using direct red 80. Studies on the dyeing behavior of corn fiber bundles using direct, reactive, vat, and sulfur dyes show that corn fibers have a dyeability similar to that of cotton.

ii. Rice Straw Fiber Bundle Blends

A. Ring Spun Blends with Cotton

Rice straw fiber bundles obtained were processed on the conventional spinning machines. Rice straw fiber bundles obtained from rice straw with an average of 20 denier were processed using a miniature spinning machinery. Rice straw fiber bundles were hand blended with cotton in the weight ratio of 50/50. The rice straw fiber bundle blends were processed through a modified card and drawframe to obtain the required grain sliver. All samples were carded twice for uniform mixing and parallelization of the rice straw fiber bundles. Slivers from the drawframe were spun directly on a miniature sliver to yarn ring spinning machine. Parameters on the ring spinning machines were adjusted to obtain various counts of yarns. The finest yarns produced from 50/50 rice straw fiber bundle/cotton blends were of 30 tex. The parameters used to process the rice straw fiber bundle blends on the ring spinning machines are provided in Table Z. The properties of the rice straw fiber bundle/cotton blended yarns were tested on standard yarn testing machines. Results show that the blended yarns have 80% of the strength and similar elongation compared to 100% cotton yarns of the same count produced using the conditions used to produce the blended yarns.

TABLE Z

Ring spinning parameters for rice straw fiber bundle blends.

| | |
|---|---|
| Yarn Count (tex) | 30–50 |
| Spindle speed (rpm) | 7,000–11,000 |
| Draft | 103–106.6 |
| Traveler | #1–#4 |
| Twist multiplier | 4.17–5.39 |

B. Open-End Spun Blends with Cotton

Various ratios of rice straw fiber bundles were blended with cotton and processed on the open end spinning machines. The fiber bundles were hand blended, processed on the card and drawframe to produce slivers. The silvers were spun into yarns on a Rieter open end spinning machine. The parameters that were used to produce various blends and counts of rice straw fiber bundles/cotton yarns on the open end spinning machines are given in Table AA. Such parameters produced 84 tex rice straw fiber bundles/cotton blended yarns in the ratio of 35% rice straw fiber bundles to 65% cotton on the open end machine. The yarns formed had about 65% strength and 80% elongation retention compared to a 100% cotton yarn of the same count produced using the same conditions of producing the blended yarn.

TABLE AA

Open-end spinning parameters for rice straw fiber bundle blends.

| | |
|---|---|
| Opening roller speed (rpm) | 7,000–9,000 |
| Opening roller type | S 21 DN |
| Rotor speed (rpm) | 60,000–85,000 |
| Rotor type | 46 U |
| Twist multiplier | 5.1–5.5 |

C. Ring-Spun Blends with Polyester

Rice straw fiber bundles with an average of 20 denier were hand blended with polyester in the weight ratio of 65% polyester to 35% rice fibers. The rice straw fiber bundle blends were processed through a modified card and drawframe to obtain the required grain sliver. All samples were carded twice for uniform mixing and parallelization of the rice straw fiber bundles. Slivers from the drawframe were spun directly on a miniature sliver to yarn ring spinning machine. Parameters on the ring spinning machines were adjusted to obtain various counts of yarns. The finest yarns produced from 65/35 polyester/rice straw fiber bundle blends were of 27 tex. The properties of the polyester/rice straw fiber bundle blended yarns were tested on standard yarn testing machines. Results show that the rice straw fiber bundle blended yarns have similar strength and elongation compared to 65/35 polyester/cotton yarns produced using the conditions used to produce the rice straw fiber bundle blended yarns.

D. Rice Straw Fiber Bundle Composites

Rice straw fiber bundles with the structure and properties as described above were made into composites intended for use in the automotive headliner industry. Rice straw fiber bundles in the ratio of 50 to 70% were blended with synthetic fibers such as polyester, polypropylene and polylactic acid. The fiber blend was carded to align the fibers. The carded web was then subject to a water lay process where the fibers become entangled to each other. The carded web is then dried and pressed at 200° C. for about 2 minutes. A composite with a thickness of about 3 to 4 mm was obtained by this process. In an advantageous embodiment, composites were produced from rice straw fiber bundles blended with other synthetic fibers. Such embodiment was advantageous for it resulted in the production of composites with greater tensile strength and resiliency than composites produced from 100% synthetic fibers alone. It is contemplated that similar composites may be produced from 100% rice straw fiber bundles and in other ratios of rice straw fiber bundles with synthetic fibers or polymers.

iii. Sorghum Fiber Bundle Composites

Composites especially targeted for the automotive headliner industry were made using sorghum stem fiber bundles. Sorghum stem fiber bundles were blended in a 50:50 weight ratio with 7 denier high density polyethylene fibers. The blended material was pressed into a composite measuring ten inches by twelve inches and with a thickness of 3.2 millimeters. The total weight of the composite was 108 grams. The composite was tested for tensile properties using an MTS tensile testing machine according to ASTM method D638-03. Dog-bone shaped samples were cut using a template with the shape as described in the type I sample of the ASTM procedure. Length of each sample was 6.5 inches with a wide width of 0.75 inches and narrow width of 0.5 inches. Similar composites made of jute were used for comparison. Results are summarized in Table BB.

TABLE BB

Properties of fibers and composites made using sorghum stem fibers compared with jute.

| | Fiber Bundle | | | Composites | |
|---|---|---|---|---|---|
| Property | Sorghum | Jute | Property | Sorghum | Jute |
| Tenacity (g/den) | 2.3 | 2.6 | Breaking load (N) | 14.0 | 10.6 |
| Breaking Elongation (%) | 2.6 | 1.5 | Breaking elongation (%) | 1.5 | 0.8 |
| Young's modulus (g/den) | 113 | 220 | Young's modulus (MPa) | 49.2 | 72.4 |

As summarized in Table BB, the composite made from sorghum fiber bundles can sustain about 30% higher breaking load and also have about 50% higher elongation compared to the jute composite. The lower modulus of sorghum composites indicates that these composites are more flexible and less stiff than jute composites. Although the sorghum fiber bundles have a lower breaking tenacity than jute, the composites made from sorghum fiber bundles sustain higher breaking load than the jute composites. This should mainly be due to the higher elongation of the sorghum fiber bundles. Since sorghum fiber bundles have higher elongation, they would perform better with the polymer matrix when the composite is deformed, such as in the tensile tests, and therefore can sustain higher loads. The higher modulus of the jute composites should be mainly due to the high modulus of jute fibers, nearly twice that of sorghum stem fiber bundles.

iv. Non-Woven Mats from Cornhusk Fiber Bundles

Cornhusk fiber bundles produced according to the present invention were used to make non-woven mats suitable for filtration and other purposes. Cornhusk fiber bundles were hand carded to orient the fiber bundles and remove some short fibers and other impurities. The carded mat was then treated with water to hydro entangle the fiber bundles into a firm mat. Water was removed from the fiber bundles using a vacuum filter and the mat was then pressed to the required thickness on a Carver press. A typical mat weighed about 200 grams and was about 1 inch thick.

o. Example 13

Bleaching i. Cornhusk

Cornhusk fiber bundles of the present invention were bleached using 3 grams per liter of 30% hydrogen peroxide at 90° C. for 60 minutes with about 7% (w/v) of fiber bundles in the bleaching solution. Included therein was 10 grams per liter of sodium silicate as a stabilizing agent along with 0.5 g/l of sodium hydroxide and 1.8 g/l of sodium carbonate to maintain the pH at about 10.5.

A Hunterlab UltrascanXE spectrophotometer was used to determine the color of the unbleached and bleached fiber bundles. The color of the fiber bundles was measured in terms of the Yellowness Index (YI) and Whiteness Index (WI) according to ASTM standard E313-98.

Bleaching of corn fiber bundles resulted in removal of the natural yellow color of the fiber bundles, reduction in denier, and an increase in the strength of the fiber bundles. Raw unbleached corn fiber bundles had a YI of 43 whereas the bleached fiber bundles had a WI of 98. As described earlier, the single cells in corn fiber bundles are very short, and the fiber bundles are formed by binding these single cells together with lignin and other binding substances. Therefore, the strength of the corn fiber bundles depends, in part, on the perfection of the binding between the single cells. It is believed that stronger bindings between the single cells are much less vulnerable than the weaker bindings to the attack by the bleaching agents. Therefore, it is believed that weak bindings in the corn fiber bundles were preferentially removed during bleaching, resulting in a decrease in denier by about 30% and an increase in strength by about 13%. Although bleaching eliminates some of the weak bindings in the fiber bundles, it may also damage the cellulose polymers through oxidation. However, the net increase in fiber bundles strength indicates that if the bleaching conditions are well controlled, the damage to the fiber bundles may be minimized.

p. Example 14

Addition of Softeners i. Switchgrass

Fiber bundles from switchgrass leaf or stem material were treated with a solution containing about 0.5% (w/w) commercially available anionic softener for about 5 minutes at ambient conditions. Treated fiber bundles were pressed to remove the softener and air dried. Addition of softeners improved the handle of fiber bundles and made them smooth. No changes in fiber bundle properties were observed.

ii. Sorghum

Fiber bundles from sorghum leaf or stem material were treated with a solution containing about 0.5% (w/w) commercially available anionic softener for about 5 minutes at ambient conditions. Treated fiber bundles were pressed to remove the softener and air dried. Addition of softeners improved the handle of fiber bundles and made them smooth. No changes in fiber bundle properties were observed.

In conclusion, the natural fiber bundles of the present invention have unique properties such as good pliability, moderate strength, durability, high elongation, and high moisture regain. The byproducts generated following cultivating food crops such as corn, wheat, rice, sorghum, barley, and soybeans provides an economical, abundant, and annually renewable source for cellulosic fiber bundles. Moreover, the fiber bundles obtained from these sources have structure and properties similar to common fibers used for textiles and other fibrous applications. The several benefits possible to agriculture, industrial materials, energy and the environment by using natural cellulose fiber sources are expected to make these fiber bundles preferable over the currently available natural and man-made fibers for certain applications.

U.S. Provisional Application No. 60/520,875, filed on Nov. 18, 2003, is incorporated by reference herein in its entirety. U.S. Patent Application 2006/0180285, filed on Jan. 24, 2006 claiming priority to U.S. Provisional Application No. 60/648,335, filed on Jan. 28, 2005 is incorporated by reference herein in its entirety.

Further, all other references cited in this specification, including without limitation all patents, journal articles, brochures, manuals, periodicals, texts, manuscripts, website publications, and any and all other publications, are hereby incorporated by reference. The discussion of the references herein is intended merely to summarize the assertions made by their authors and no admission is made that any reference constitutes prior art. Applicants reserve the right to challenge the accuracy and pertinence of the cited references.

It is to be understood that the above description is intended to be illustrative and not restrictive. Many embodiments will be apparent to those of skill in the art upon reading the above description. The scope of the invention should therefore be determined not with reference to the above description alone, but should be determined with reference to the claims and the full scope of equivalents to which such claims are entitled.

When introducing elements of the present invention or an embodiment thereof, the articles "a", "an", "the" and "said" are intended to mean that there are one or more of the elements. The terms "comprising", "including" and "having" are intended to be inclusive and mean that there may be additional elements other than the listed elements. Additionally, it is to be understood an embodiment that "consists essentially of" or "consists of" specified constituents may also contain reaction products of said constituents.

The recitation of numerical ranges by endpoints includes all numbers subsumed within that range. For example, a range described as being between 1 and 5 includes 1, 1.6, 2, 2.8, 3, 3.2, 4, 4.75, and 5.

What is claimed is:

1. A method for extracting natural cellulosic fiber bundles from wheat straw, which comprises wax on its surface, the method comprising performing a detergent treatment on the wheat straw to remove at least a portion of the wax from the surface of the wheat straw, performing an alkali treatment on the detergent-treated wheat straw to partially delignify the wheat straw and performing an enzyme treatment on the detergent-treated wheat straw to depolymerize hemicellulose, break covalent links between lignin and carbohydrates, and decompose cellulose chains in the wheat straw, or a combination thereof thereby yielding the extracted natural cellulosic fiber bundles, wherein said extracted natural cellulosic fiber bundles have a length that is greater than that of individual cells and a fineness of at least about 1 denier and no greater than about 300 denier.

2. The method of claim 1 wherein the natural cellulosic fiber bundles have a length between about 0.5 and about 20 centimeters and a fineness between about 12 and about 180 denier.

3. The method of claim 1 wherein the alkali treatment comprises contacting the detergent-treated wheat straw with an alkali solution for a duration of about 15 to about 90 minutes to form a mixture having an alkali solution-to-solid ratio between about 1:1 and about 100:1 and a temperature within a range of about 60 to about 100° C., wherein the alkali solution comprises an alkali compound and has a normality that is between about 0.05 and about 2.5N.

4. The method of claim 3 wherein the alkali compound is selected from the group consisting of alkali metal hydroxide, alkaline earth metal hydroxides, alkali metal carbonates, alkaline earth metal carbonates, and combinations thereof.

5. The method of claim 1 wherein the enzyme treatment comprises contacting the detergent-treated wheat straw with an enzyme solution that comprises an enzyme at a concentration that is between about 0.05 and about 5 percent for a duration of about 10 to about 60 minutes to form a mixture having an enzyme solution-to-solid ratio between about 1:1 and about 100:1 and is at a temperature within a range of about 10 to about 65° C.

6. The method of claim 5 wherein the enzyme is a xylanase, a cellulase-type enzyme, or a combination thereof, in which the cellulose-type enzyme is selected from the group consisting of endoglucanases, cellobiohydrolases, β-glucosidases, and combinations thereof.

7. The method of claim 1 wherein the detergent treatment comprises contacting the wheat straw with a detergent solution that comprises a detergent solution having a detergent concentration that is between about 0.05 and about 30% (w/v) for a duration that is between about 20 minutes and about 24 hours maintained within the temperature range of about 0 to about 100° C.

8. A method for extracting natural cellulosic fiber bundles from cornhusks, the method comprising:

performing a first portion of an enzyme treatment on a cornhusk material, the first portion of the enzyme treatment comprising contacting the cornhusk material with a first enzyme solution that comprises a xylanase at a concentration that is between about 0.05 and about 5 percent for a duration of about 10 to about 60 minutes to form a first mixture having a first enzyme solution-to-husk ratio between about 1:1 and about 100:1 and is at a temperature within a range of about 10 to about 65° C.;

separating the first mixture into a first solid portion comprising the cornhusk material and a first liquid portion comprising the first enzyme solution;

performing an alkali treatment on the first solid portion, the alkali treatment comprising contacting the cornhusk material with an alkali solution for a duration of about 15 to about 90 minutes to form a second mixture having an alkali solution-to-solid ratio between about 1:1 and about 100:1 and is at a temperature within a range of about 60 to about 100° C., wherein the alkali solution comprises an alkali compound and has a normality that is between about 0.05 and about 2.5N;

separating the second mixture into a second solid portion comprising the cornhusk material and a second liquid portion comprising the alkali solution;

performing a second portion of the enzyme treatment on the second solid portion, the second portion of the enzyme treatment comprising contacting the cornhusk material with a second enzyme solution that comprises a cellulase at a concentration that is between about 0.05 and about 5 percent for a duration of about 10 to about 60 minutes to form a third mixture having a second enzyme solution-to-solid ratio between about 1:1 and about 100:1 and is at a temperature within a range of about 10 to about 65° C.; and separating the third mixture into a second solid portion comprising the natural cellulosic fiber bundles and a third liquid portion comprising the second enzyme solution.

9. The method of claim 8 further comprising:

rinsing the first solid portion, the second solid portion, and third solid portion with water;

contacting the rinsed second solid portion with an acid solution to neutralize any remaining alkali solution and then rinsing the second solid portion with water; and drying the rinsed natural cellulosic fiber bundles.

10. A method for extracting natural cellulosic fiber bundles from wheat straw, which comprises wax on its surface, the method comprising:

performing a detergent treatment on the wheat straw to remove at least a portion of the wax from the surface of the wheat straw, wherein the detergent treatment comprises contacting the wheat straw with a detergent solution having a detergent concentration that is between about 0.05 and about 30% (w/v) for a duration that is between about 20 minutes and about 24 hours maintained within the temperature range of about 0 to about 100° C.;

performing an alkali treatment on the detergent-treated wheat straw, the alkali treatment comprising contacting the detergent-treated wheat straw with an alkali solution for a duration of about 15 to about 90 minutes to form a first mixture having a alkali solution-to-solid ratio between about 1:1 and about 100:1 and is at a temperature within a range of about 60 to about 100° C., wherein the alkali solution comprises an alkali compound and has a normality that is between about 0.05 and about 2.5 N;

separating the first mixture into a first solid portion comprising the wheat straw and a first liquid portion comprising the alkali solution;

performing an enzyme treatment on the first solid portion, the enzyme treatment comprising contacting the first solid portion with an enzyme solution that comprises an enzyme at a concentration between about 0.05 and about 5 percent for a duration of about 10 to about 60 minutes to form a second mixture having an enzyme solution-to-solid ratio between about 1:1 and about 100:1 and is at a temperature within a range of about 10 to about 65° C.; and separating the second mixture into a second solid portion comprising the natural cellulosic fiber bundles and a second liquid portion comprising the enzyme solution.

11. The method of claim 10 wherein the enzyme is a xylanase, a cellulase-type enzyme, or a combination thereof.

12. The method of claim 10 further comprising:

rinsing the first solid portion and the second solid portion with water;

contacting the rinsed second solid portion with an acid solution to neutralize any remaining alkali solution and then rinsing the second solid portion with water; and drying the rinsed natural cellulosic fiber bundles.

* * * * *

UNITED STATES PATENT AND TRADEMARK OFFICE

CERTIFICATE OF CORRECTION

PATENT NO. : 7,887,672 B2
APPLICATION NO. : 11/675982
DATED : February 15, 2011
INVENTOR(S) : Yiqi Yang and Narendra Reddy It is certified that error appears in the above-identified patent and that said Letters Patent is hereby corrected as shown below:

On the Title Page

Item (75) the spelling of Inventor Narenda Reddy should be corrected as Narendra Reddy Signed and Sealed this
Twenty-third Day of October, 2012

David J. Kappos

David J. Kappos
*Director of the United States Patent and Trademark Office*